United States Patent [19]

Elliston

[11] 4,290,495

[45] Sep. 22, 1981

[54] PORTABLE WORKOVER RIG WITH EXTENDABLE MAST SUBSTRUCTURE, PLATFORM MOUNTED DRAWWORKS AND ADJUSTABLE WELLHEAD ANCHOR

[75] Inventor: Thomas L. Elliston, Fort Worth, Tex.

[73] Assignee: Hydra-Rig, Inc., Fort Worth, Tex.

[21] Appl. No.: 49,954

[22] Filed: Jun. 18, 1979

[51] Int. Cl.[3] ..... E21B 15/00; E21B 19/14

[52] U.S. Cl. ..... 175/85; 52/115; 166/77; 166/77.5; 173/23; 173/28; 173/57; 173/147; 254/93 VA

[58] Field of Search ..... 173/57, 147, 151, 23, 173/28; 175/52, 85; 254/93 VA, 139.1; 52/117, 119, 115, 120; 166/77, 77.5

[56] References Cited

U.S. PATENT DOCUMENTS

| | | | |
|---|---|---|---|
| 2,200,075 | 5/1940 | Caldwell | 173/28 X |
| 2,595,307 | 5/1952 | Selberg | 173/28 X |
| 2,703,634 | 3/1955 | Lee | 52/115 |
| 2,742,260 | 4/1956 | Patterson | 173/28 X |
| 2,767,812 | 10/1956 | Boger | 52/120 |
| 3,050,159 | 8/1962 | Paulus et al. | 52/115 |
| 3,089,550 | 5/1963 | Watson | 173/28 |
| 3,172,485 | 3/1965 | Spannhake et al. | 173/147 |
| 3,299,957 | 1/1967 | O'Neill et al. | 173/28 X |
| 3,340,938 | 9/1967 | Wilson | 173/28 |
| 3,695,351 | 10/1972 | Lubinski | 175/171 X |
| 3,719,238 | 3/1973 | Campbell et al. | 173/147 |
| 3,752,229 | 8/1973 | Pridy | 254/139.1 |
| 3,774,697 | 11/1973 | Brown | 173/57 X |
| 3,792,836 | 2/1974 | Bender | 166/72 |
| 3,934,381 | 1/1976 | Bouma | 52/115 X |
| 3,960,360 | 6/1976 | Elliston | 173/147 X |

*Primary Examiner*—Ernest R. Purser
*Attorney, Agent, or Firm*—Hubbard, Thurman, Turner, Tucker & Glaser

[57] ABSTRACT

A portable workover rig for handling a pipe string in a well casing includes a base platform and a collapsible mast which is movable from a reclining transport position to an erect elevated position of use. The mast is supported for free-standing operation by a carriage assembly including a cantilever support base mounted on the base platform for pivotal movement from the transport position to the position of use. The carriage assembly includes lift arms coupled in parallel relation intermediate the cantilever support base and the rig support platform for maintaining the cantilever support base in parallel alignment with the base platform. Hoisting and snubbing operations are performed by drawworks including a linear hydraulic actuator carried on the base platform, a traveling block supported for vertical movement along the mast by hoist and snub cables, and traveling sheaves carried by the actuator through a stroke pathway which is oriented transversely with respect to the mast. A vertically adjustable stack assembly is provided for accommodating the varying elevations of existing wellhead flange connections and for anchoring the rig platform to the wellhead casing. A powered drill sub assembly includes upstanding stab receptacles anchored to the top side of the traveling block and stab elements supported for vertical reciprocal movement between retracted and extended positions to permit displacement of the power sub relative to the traveling block during makeup and breakout operations.

57 Claims, 24 Drawing Figures

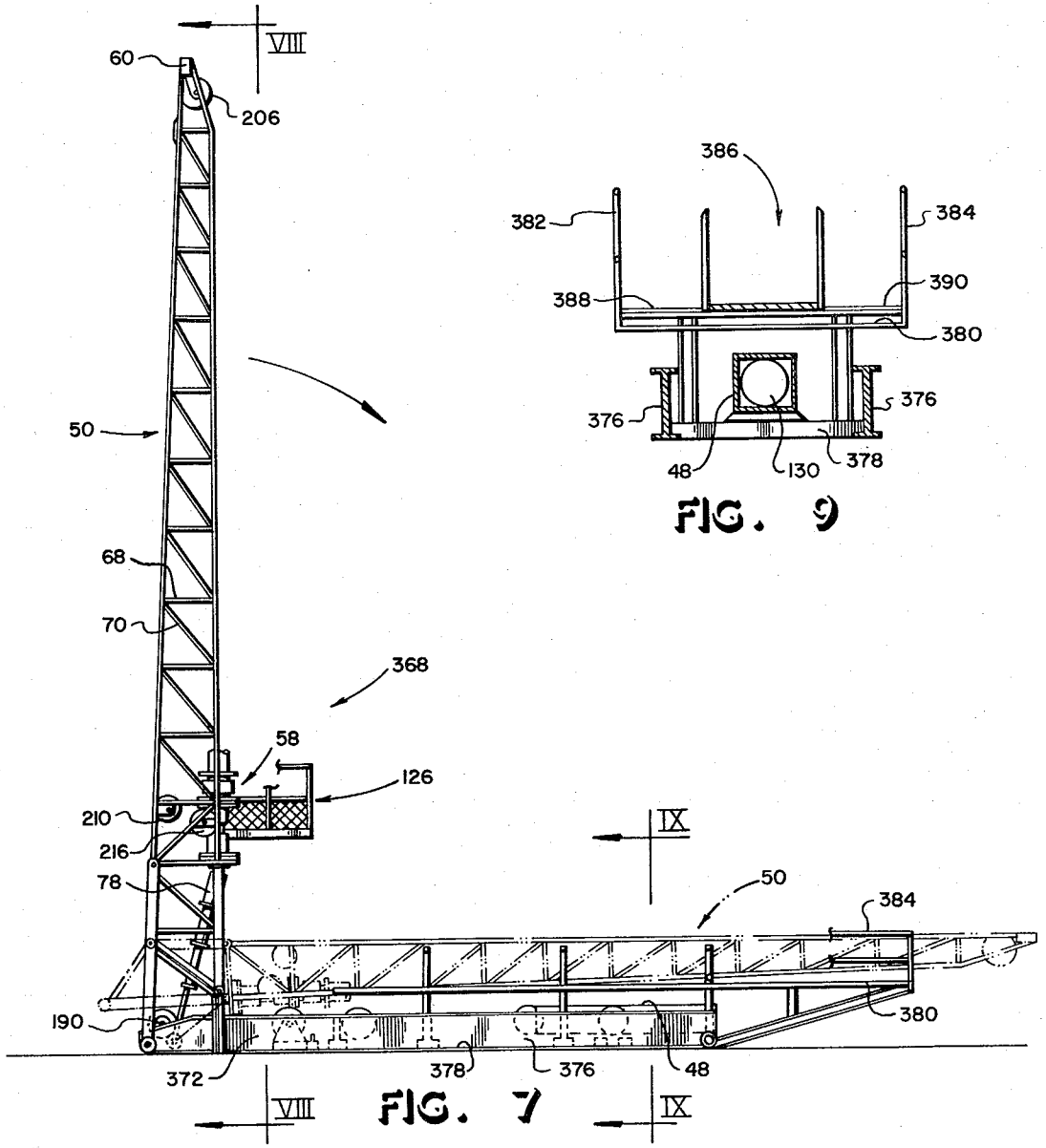
FIG. 9
FIG. 7
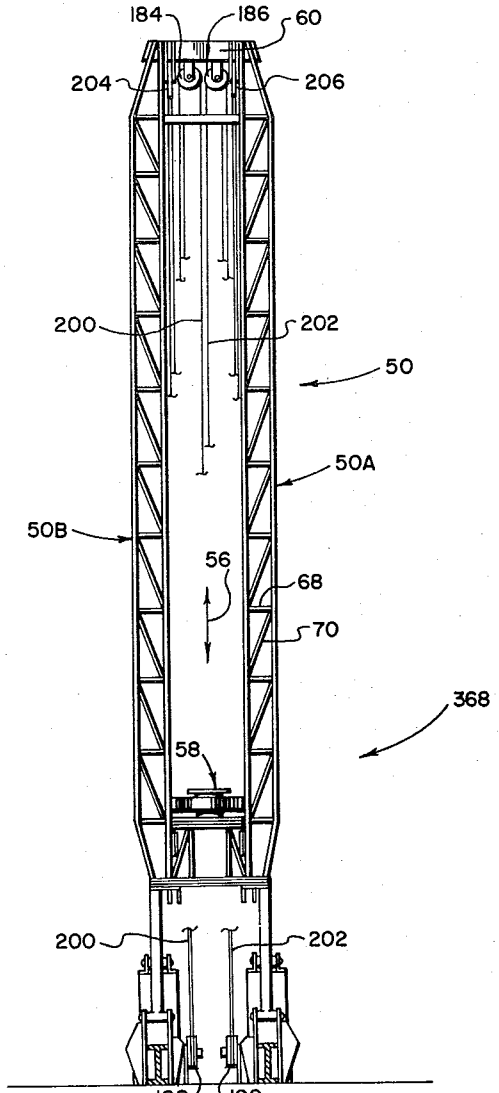
FIG. 8

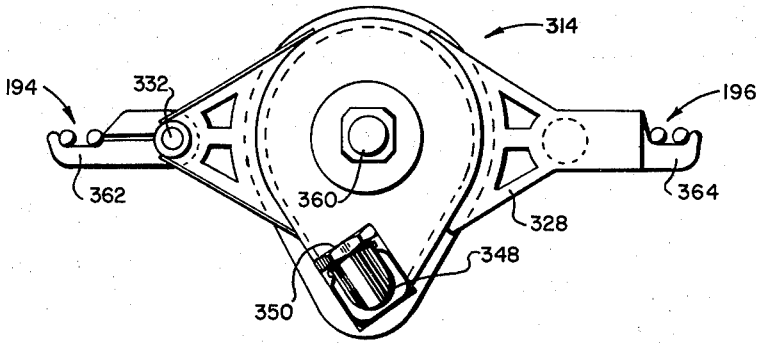
FIG. 22
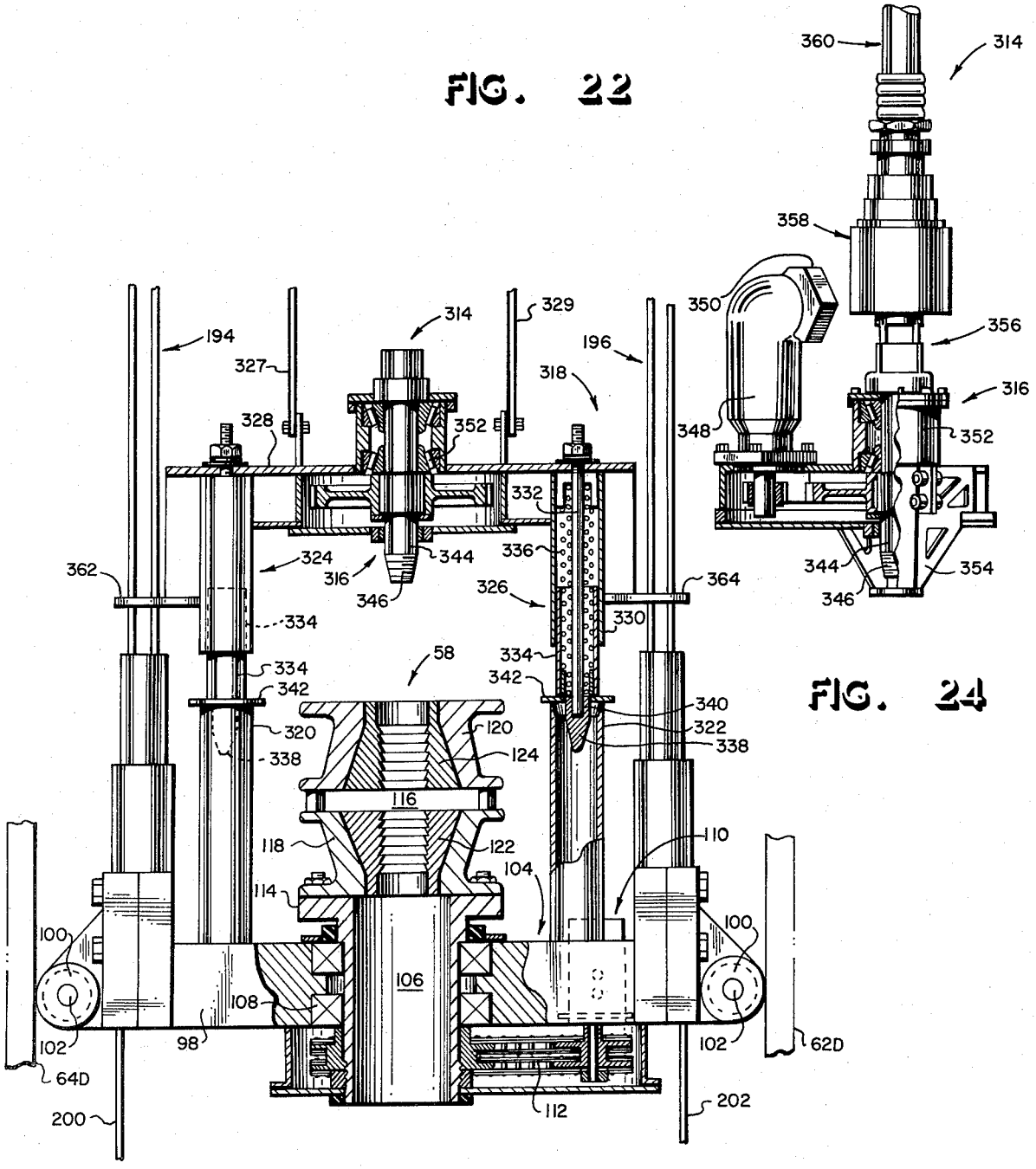
FIG. 24
FIG. 23

PORTABLE WORKOVER RIG WITH EXTENDABLE MAST SUBSTRUCTURE, PLATFORM MOUNTED DRAWWORKS AND ADJUSTABLE WELLHEAD ANCHOR

BACKGROUND OF THE INVENTION

1. Field of the Invention

The claimed invention relates generally to well drilling and servicing equipment, and more specifically to portable rigs for handling pipe strings when making up and disconnecting long strings of pipe used in a bore hole during operations that are carried out in the exploration and production of petroleum and other fluids and minerals from substantial depths below the earth's surface.

2. Description of the Prior Art

Production wells must be worked over from time-to-time due to either faulty downhole equipment or to some unusual or adverse well condition. For example, if the production string is damaged or leaking, it may be necessary to pull the tubing from the casing and replace it with new string. In a gas lift installation, the gas lift valves may not be in good working condition, and it therefore may be necessary to run exchange gas lift valves into the well. When tubing becomes plugged with sand, it is necessary to insert a tool such as a macaroni work string into the pipe to ream out or flush out the material clogging the flow of oil through the pipe. Other remedial service operations include gravel packs, fishing jobs, plug backs, recompletion requiring pulling and reinstallation of production tubing, drill-out of cement plugs, running sand screens and sand packing.

When such service operations become necessary, a portable installation called a workover rig is brought to the well site and set up. Generally, these rigs consist of a derrick or mast which supports pulleys or block and tackle arrangements that are operable to pull the pipe string from the well. These prior art workover rigs are usually heavy and difficult to erect and further often have the limited operational capability of only being able to hoist or pull pipe from a well without the capability of snubbing or pushing pipe back into the well. Since these conventional workover rigs cannot develop a downward force to push a string of pipe into the well, in such operations the well must necessarily always be under control or "dead", as is known in the art. This may require a preparatory operation of injecting a suitable substance such as mud or "kill" fluid into the well to maintain sufficient column weight of fluid to resist the pressure within the well which is tending to force the tubing out. However, it is usually desirable to carry out the workover operations without resorting to the injection of "kill" fluid into the well since the well may be lost if the formation is damaged because of the presence of the workover "kill" fluid. In such "killing" workover operations, there is a very high risk that the productivity of the subsurface formation may decline so severely after killing the well that the well must be abandoned.

An overriding concern in the construction of workover rigs is to get the necessary equipment into and out of the well as rapidly and safely as is economically possible. This concern has led to the development of a portable well service rig having a transportable mast or derrick. Before the invention of the first portable well service unit, it was necessary to leave the drilling derrick in place over the well for use in future well service operations. The portable well service rig eliminated the need for a permanent derrick and thus materially reduced overall well service costs. The early portable rigs, however, were unloaded in a heap and later sorted out, and then assembled without any definite plans therefore consuming a substantial amount of time in rigging up. Even when unitized and transported on pallets, a significant amount of time was required for transporting, rigging up and dismantling the palletized equipment. In the palletized approach, the field assembly and erection of the mast, mast support structure and reeving of the hoist cable caused expensive but unavoidable delays. Therefore recent improvements to conventional portable workover rigs have focused on changes which simplify the operations of transporting, rigging up and dismantling.

One of the problems associated with the development of the portable workover rig is that of providing sufficient working space below the mast floor while limiting the mast and its supporting base to dimensions which permit its transportation across public highways. A working space must be provided below the mast floor in order that the mast can be supported vertically above and engage well head equipment which may extend as much as eight to ten feet above the elevation of the rig platform deck. The minimum height of the mast is determined primarily by the length of the sections of pipe string added to or removed from the pipe already in the well bore. However, if the mast is so high that its length and height clearance when in a horizontal position on the workover rig exceeds the limits allowed by the state, the mast must be at least partially disassembled or must be telescoped. Most wells have tubing sections which are in the range of thirty-six to forty feet long, so that the construction of a transportable mast assembly having a stroke for accomodating the removal or insertion of such tubing sections poses no problem insofar as complying with state highway regulations.

As mentioned above, the conventional practice has been to provide a mast having telescoping sections or having sections which must be separately assembled and erected on site. To provide ample clearance for the well head equipment, the mast floor has been elevated above the ground level by placing it on a mast substructure carried by the rig base platform. This substructure is normally fabricated of heavy structural steel in a massive weldment which must be separately transported. The loads it must bear are greater than those born by the mast, since the substructure must support not only the weight of the derrick with its pipe string load, but other loads, such as the rotary table and draw works as well. However, the length and height of the separate mast support base when combined with the reclining mast may in some cases exceed highway limits, so that separate transportation, field assembly and erection are required. Most conventional rigs provide separate support base and mast sections which may be unbolted and separately transported to provide the short lengths allowed for highway travel. However, additional rigging up and tear down time is required for such arrangements.

Other important considerations involved in the construction of portable workover rigs are the strength and stability of the mast. The mast must be constructed to safely carry all loads which will ever be used in the well over which it is placed. This is the collapse resistance caused by vertical loading, or the dead load capacity of the mast. The largest dead load which will be imposed on the derrick will normally be the heaviest string of production tubing run in the well. However, this heaviest string of tubing will not be the greatest strain placed on the mast. The maximum vertical load which will ever be imposed on the mast will probably be the result of pulling on equipment, such as drill pipe or casing, that has become stuck in the hole. Therefore it must be considered that, sometime during the useful life of the mast, severe vertical strain will be placed on it because the equipment has become stuck in the hole. Therefore the mast and its intermediate support platform must be constructed to withstand and react loads which will exceed the capacity of the hoist line which will be used on the rig.

The mast must be also designed to withstand the maximum wind loads to which it will be subjected. The horizontal force of the wind acting on the mast and production tubing is usually counteracted by using from one to three guy wires along each leg of the mast which are attached to "dead man" anchors located some distance from the mast. A "dead man" anchor is made from a short length of large pipe, a concrete block, or a short section of timber, which is buried in the ground to provide an anchor for the guy wire. A substantial amount of time and labor is expended in setting up the "dead man" support lines. Additionally, when carrying out workover operations off shore, there is no practical way to anchor the guy lines. A suitable structural alternative for the guy wire supports is necessary for reacting the wind loads, and the snubbing forces must also be reacted in order to drive production tubing into an offshore well against the downhole pressures which may be encountered. Therefore there is a continuing interest in improving the design of support substructure for free-standing masts which do not require guy wires for support.

As a result of the many improvements to portable workover rigs, such vehicles now transport practically all the necessary servicing equipment directly to the field locations and when servicing has been completed, remove the necessary equipment to another well in need of service in the same field or in a different field miles away. Thus the equipment necessary to service a number of wells each having different service requirements has been greatly reduced, and consequently the labor and cost, as well as the amount of equipment has correspondingly dropped. However, there still remains considerable interest in the provision of more efficient and simplified machines in order that the job of well servicing in general may be carried out efficiently and at reasonable cost.

OBJECTS OF THE INVENTION

It is, therefore, the principal object of the present invention to provide an improved general purpose workover rig having a unitized configuration which is transportable across public highways and which can be easily rigged up and dismantled in the field.

An important object of the invention is the provision of a mast assembly which is transportable on a base platform having a mast and a mast support substructure which can be separately collapsed for transport in a low profile, reclining position over the base platform to comply with the length and height limitations established for public highways, and which are erectable to an elevated operating position overlying well head equipment.

Yet another object of the invention is the provision of a transportable mast assembly having a base support substructure for supporting the mast in freestanding relation for withstanding wind loading without the use of dead man anchor lines.

Still another object of the invention is the provision of a workover rig having a mast, a mast support substructure, and draw works in which the static load of the draw works is supported by a portable base platform member rather than by being supported by the intermediate mast support substructure.

Another object of the invention is the provision of an erectable mast support substructure which cooperates with a portable base platform for stabilizing a free-standing mast erected on the support substructure and reacting vertically directed snubbing forces without the use of dead man anchor lines.

Yet another object of the invention is the provision of a workover rig having draw works carried by a portable platform and a mast and mast support substructure which are separately movable from a reclining transport position to an erect operating position wherein erection and retraction of the mast and mast support assembly can be carried out without disturbing cable reeving on the mast or on the draw works.

An important object of the present invention is the provision of draw works for a workover rig which can be carried in a reclining position on a portable rig platform and which is operably connected to develop driving forces required for either hoisting or snubbing operations.

Still another object of the invention is the provision of a portable workover rig having a mast and mast support substructure which are separately movable from a reclining transport position over a portable base platform to an erect workover position overlying well head equipment lying either above or below the elevation of the portable base platform.

A further object of the invention is the provision of a carriage assembly for a cantilever mast support substructure for maintaining the cantilever mast support substructure in parallel alignment with the base platform throughout the range of movement from a reclining transport position to an erect operating position.

Yet another object of the invention is the provision of a base support substructure for an erectable mast and a carriage assembly for moving the base support substructure from a reclining transport position over a portable base platform to an erect workover position, the carriage assembly cooperatively coupled to the base platform for stabilizing the erectable mast in free-standing relation on the mast support substructure and for transmitting mast load reaction forces through the portable base platform.

Another object of the invention is the provision of a workover rig having an erectable mast supported on a cantilever support substructure which is movable from a reclining transport position overlying a portable base platform to an elevated position of use wherein the cantilever support base is extended beyond the portable base platform for carrying out workover operations.

Still another object of the invention is the provision of a vertically adjustable stack assembly for accomodating the varying elevations of existing well head flange connections and which further serves to transfer the weight of a mast from an intermediate support structure to the well casing and for simultaneously anchoring a portable base platform to the well head casing, thereby further stabilizing the mast support substructure.

A related object is the provision of a bolster assembly for attachment to the vertically adjustable stack assembly for providing lateral support for a length of pipe string extending between the mast and the well head equipment to prevent buckling of the length of pipe string when it is undergoing compression loading during either snubbing or drilling operations.

Finally, it is an important object of the present invention to provide a powered drill sub assembly for carrying out drilling operations in combination with a transportable mast assembly which includes a vertically yieldable stab assembly interconnecting a powered drill sub to a traveling block thereby permitting vertical displacement of the power sub relative to the traveling block during tubing make-up and break-out operations while reacting torque forces which are produced by such operations.

SUMMARY OF THE INVENTION

The foregoing objects are achieved by a workover rig which is mounted on a portable base platform such as a skid or the bed of a trailer vehicle, and which features a collapsible mast assembly which is movable from a reclining transport position to an erect elevated position of use. The mast assembly is supported for free-standing operation by a carriage assembly including a cantilever substructure support base mounted on the rig support platform for pivotable movement from the reclining transport position to an elevated position of use. The carriage assembly includes lift arms coupled in parallel relation intermediate the cantilever support structure and the rig support platform, thereby defining a parallelogram throughout the range of movement of the mast support assembly for maintaining the cantilever support base in parallel alignment with the base platform. According to this arrangement, the mast and the carriage assembly are separately collapsible for transport in a low profile, reclining position over the base platform to comply with the length and height limitations established for public highways. The mast and the carriage assembly are separately erectable to an elevated operating position overlying well head equipment which may be disposed at an elevation either above or below the elevation of the portable base platform. The mast is connected in hinged engagement with the carriage assembly, and both the carriage assembly and the mast are separately driven from the transport position to the erect operating position by linear hydraulic actuators. The linear hydraulic actuators in combination with the carriage assembly serve to stabilize the mast for free-standing operation and transmit mast load reaction forces through the portable base platform. An important feature of this arrangement is the cantilever support substructure which is extended to an elevated operating position beyond the portable base platform for carrying out workover operations adjacent elevated well head equipment. A further advantage of this arrangement is that the mast, mast support substructure, and draw works can be carried in a collapsed, low profile transport position and both erection and retraction of the mast and mast support assembly can be carried out without disturbing the cable reeving on the mast and draw works.

According to an important aspect of the invention, the workover rig is provided with a mast, a mast support substructure, and draw works in which the static load of the draw works is supported by a portable base platform member rather than being supported by the intermediate mast support substructure. In this arrangement, the draw works includes a linear hydraulic actuator having rod and housing elements in which one of the elements is anchored to the base platform with the other element being mounted for movement along the base platform through a stroke pathway which extends transversely with respect to the mast. The traveling sheaves are cooperatively reeved with hoist and snub cables for developing driving forces required for either hoisting or snubbing operations. The advantage of this arrangement is that the intermediate mast support substructure must support only the mast in an erect operating position with the substantial weight of the draw works being supported by the portable base platform. This arrangement permits the mast support substructure to be easily movable from the reclining, low profile transport position to the elevated workover position without the burden of the draw works. Hoisting and snubbing operations are carried out by the draw works which includes a linear hydraulic actuator carried on the base platform, a load engaging traveling block supported for vertical movement along the mast by hoist and snub cables, and by traveling sheaves carried by the actuator through a stroke pathway which is oriented transversely with respect to the mast. In this arrangement the load engaging traveling block is driven upwardly or downwardly along the mast in response to extension and retraction of the rod and housing elements of the hydraulic actuator.

In yet another important embodiment of the invention, a vertically adjustable stack assembly is provided for accomodating the existing elevation of well head flange connections. The vertically adjustable stack assembly includes an adjustable support column assembly anchoring the rig platform to the well head casing, and an adjustable support column assembly interposed between the well head casing and the mast for transferring the weight of the mast from the intermediate mast support structure to the well casing. The vertically adjustable stack assembly simultaneously anchors the portable base platform to the well head casing, thereby stabilizing the mast support substructure, while relieving the burden of the mast from the intermediate mast support substructure. This arrangement helps stabilize the mast for free-standing operation on the mast support substructure and for transmitting mast load reaction forces through the portable base platform, thereby eliminating the need of dead man anchor lines which would otherwise be required for stabilizing the mast and for reacting dynamic mast loads.

According to another important embodiment of the invention, a bolster assembly is attached to the adjustable stack connector assembly for providing lateral support to a length of pipe string extending between the mast and the well head flange. In a preferred embodiment, the bolster assembly includes a number of bolster plates each having central openings for receiving the length of pipe string with link elements interconnected in a scissors arrangement on opposite sides of the bolster plates for permitting accordion-like movement of the bolster plates relative to each other in parallel, stacked relation and with their central openings concentrically aligned. The bolster plates are fastened to the adjustable stack connector and provide lateral support to the length of pipe string extending between the mast and well head equipment to prevent buckling of the length of the pipe string when it is undergoing compression loading during either snubbing or drilling operations.

Finally, the portable workover rig of the invention is adapted to perform drilling operations by the combination of a vertically yieldable stab assembly which interconnects a powered drill sub with a traveling block for permitting vertical displacement of the powered drill sub during make-up and break-out operations while simultaneously reacting torque forces which arise in response to rotary forces applied to the drill string. The vertically yieldable stab assembly includes upstanding stab receptacles anchored to the top side of the traveling block and stab elements downwardly depending from the under side of the powered drill assembly for engagement with the stab receptacles. Each stab element is supported for vertical reciprocal movement between retracted and extended positions, and each stab element is yieldably biased to the fully extended position, thereby permitting vertical displacement of the power sub relative to the traveling block during the make-up and break-out operations while reacting torque forces which are produced by operation of the powered drill sub.

Thus, from the above brief summary, it will be seen that the claimed inventions comprehend the following embodiments:

(1) Transportable mast assembly
(2) Draw works
(3) Adjustable stack connector
(4) Pipe string bolster assembly
(5) Powered drill sub
(6) A workover rig having one or more of the above embodiments combined in a unitized portable assembly.

DESCRIPTION OF THE DRAWING

The foregoing and other related objects and advantages of the present invention will become more apparent from the following specification, claims and appended drawings wherein:

FIG. 7 is a side elevational view of a skid mounted workover rig having draw works and an erectable mast constructed according to the teachings of the present invention;

FIG. 8 shows a sectional view of the skid mounted workover rig taken along the line VIII—VIII of FIG. 7;

FIG. 9 is a sectional view of the skid mounted workover rig taken along the line IX—IX of FIG. 7;

FIG. 22 is a simplified top plan view of a powered drill sub;

FIG. 23 is an elevation view, partly in section, showing the powered drill sub coupled in yieldable engagement with a traveling block for carrying out drilling operations; and, FIG. 24 is a side elevation view of the powered drill sub which illustrates its principal components.

DESCRIPTION OF THE PREFERRED EMBODIMENTS

Figure 1:
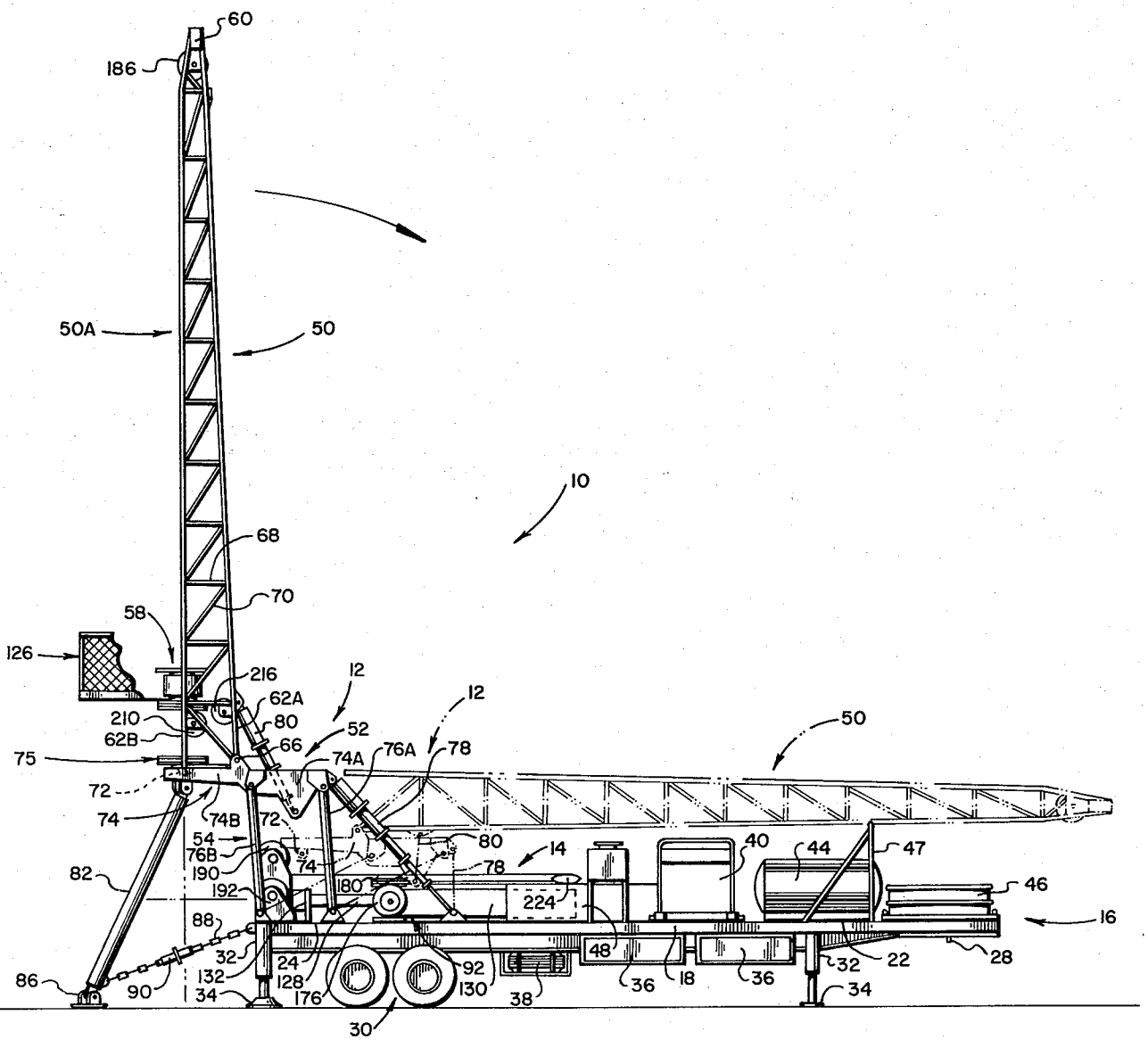
FIG. 1 is a side elevational view of the workover rig of the present invention which illustrates the mast in the fully erect workover position.

In the description which follows, like parts are marked throughout the specification and drawings with the same reference numerals, respectively. The figures are not necessarily drawn to scale and in some instances portions have been exaggerated in order to more clearly depict certain features of the invention.

Figure 2:
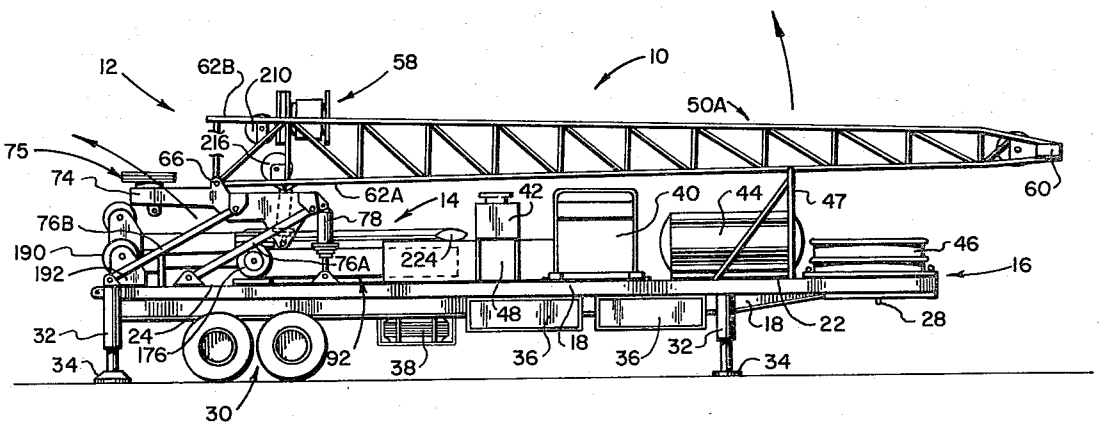
FIG. 2 is a side elevational view of the workover rig shown in FIG. 1 in which the mast is disposed in a reclining transport position.
Figure 3:
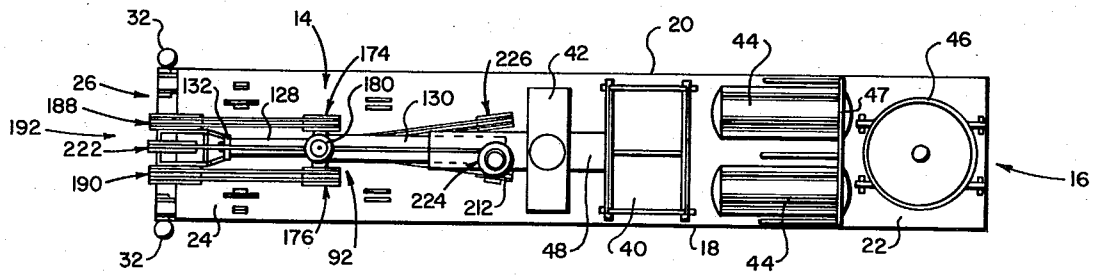
FIG. 3 is a top plan view of the workover rig of FIG. 1 with the mast and carriage assembly removed which illustrates the layout of the draw works and related equipment on the deck of a portable rig support platform.

Referring now to the drawings, and more particularly to FIGS. 1–4, a workover rig 10 is shown having a transportable mast assembly 12 and draw works 14 supported on a portable trailer platform 16. The trailer platform 16 includes the usual longitudinal side frame rails 18, 20 which supports forward and rear decks 22, 24, respectively. The side rails 18, 20 are interconnected by the usual structural members, including a tailboard 26. The trailer platform 16 includes a fifth wheel connection 28 for attachment to a tractor, and rear wheels 30 supported by shock assemblies and leaf springs in the usual manner. Outrigger jacks or props 32 support the side frame rails 18, 20 to prevent tilting or overturning of the rig during operation and also for maintaining the orientation of the trailer platform 16 once it has been set up. The jacks 32 are preferably hydraulically actuated and are controlled from a central station so that the trailer platform 16 can be aligned in parallel with the ground or inclined in a tilted position for workover of slant wells. Each jack 32 is equipped with a stabilizer pad 34 for engaging a mud sill (not shown) so that the trailer load can be more evenly distributed. Slung underneath the side frame rails 18, 20 are tool boxes 36 and a spare tire 38. Anchored top side on the forward deck 22 is power unit 40 which develops the main hydraulic power for the draw works 14 and includes hydraulic pumps driven by a diesel engine. The power unit is coupled to a hydraulic reservoir 42 so that as the required pressure in the system exceeds predetermined levels, one or another pump automatically unloads into the reservoir 42 and all engine horse power is then diverted for driving the alternate pump(s). Immediately forward of the power unit 40 are a pair of fuel tanks 44, and overlying the fifth wheel connection 28 is a hose basket 46. Overlying the fuel tanks is an upstanding stop bar 47 for engaging the mast assembly and supporting it in spaced relation with the forward deck overlying the power unit and fuel tanks when the transportable mast assembly 12 is disposed in its reclining transport position, as illustrated in FIGS. 1 and 2. Also anchored to the trailer platform 16 intermediate the forward and rear decks is a guide tube 48 which is straddled by the hydraulic reservoir 42 for receiving the movable actuator element of the draw works 14 as will be discussed in greater detail below.

Transportable Mast Assembly

Referring again to FIGS. 1–4, the transportable mast assembly 12 comprises generally an elongated mast 50 pivotally mounted on a mast support substructure 52 which is in turn pivotally mounted on a mast carriage assembly 54 which is mounted for pivotal movement from a transport position shown in FIG. 2 to an elevated position of use shown in FIG. 1. The mast 50 is formed by two upstanding mast sections 50A, 50B which are laterally spaced to define a vertical load transport zone 56 through which a traveling block 58 is transported during pipe running operations. The upper ends of the mast sections 50A, 50B are structurally interconnected by a crown block 60 which improves the mechanical stability of the mast and which also serves to support crown block sheaves in a manner to be disclosed hereinafter. Each mast section 50A, 50B is defined by four leg members 62A, 62B, 62C and 62D, and 64A–D, respectively. The leg members are generally arranged at the corners of a square with the forward leg portions terminating in a clevis which receives a hinge pin 66 which pivotally secures the forward legs to the mast support substructure 52. Each mast section 50A, 50B is provided with girt members 68 and brace members 70 which are structurally interconnected with the leg members to insure rigidity of each mast section. A clevis 72 is anchored on opposite sides of the mast support substructure 52 for anchoring the rear legs 62B, 64B of the mast when it has been erected to the upright position.

The mast support substructure is characterized by a cantilever support base 74 which is pivotally coupled to the mast carriage assembly 54. The cantilever support base 74 serves as an intermediate mast support substructure for supporting the upstanding mast 50 in an elevated position beyond the tailboard 26 and above well head equipment. The cantilever support base 74 assumes the form of a rectangular frame having a forward section 74A for pivotal engagement with the mast carriage assembly 74 and a rear portion 74B which forms the substructure support for the mast 50. A slip assembly 54 is anchored onto the cantilever support base for assisting the traveling block 58 during pipe gripping operations.

The mast carriage assembly 54 includes forward and a rear lift arms 76A, 76B, respectively, pivotally coupled in clevis connections intermediate the cantilever support base 74A and the rear deck 24 on laterally opposite sides of the draw works 14. The lift arms are all the same length and are spaced in parallel with each other whereby the combination of each pair of lift arms with the cantilever support base and the rear deck defines a parallelogram for maintaining the mast support substructure 52 in parallel alignment with the trailer platform 16 throughout the range of movement of the mast support substructure 52 from the reclining transport position to the elevated position of use. The mast support substructure 52 is extended and retracted between the reclining transport position and the elevated position of use by a pair of double acting, telescoping hydraulic actuators 78 having housing and rod elements pivotally coupled to clevis connections carried on the forward cantilever support base portion 74A and the rear deck 24 on laterally opposite sides of the draw works 14. The mast 50 is similarly erected by hydraulic lift cylinders 80 which are coupled for pivotal movement intermediate the forward cantilever support base portion 74A and the forward legs 62A, 64C of the mast sections 50A, 50B, respectively.

The mast support substructure 52 is further stabilized by struts 82, 84 which are pivotally connected on one end to the rear cantilever support base porition 74B, with the opposite ends equipped with stabilizer pads 86 for engaging the ground. Chains 88 are connected between each strut and the tailboard 26 for limiting the outward extension of the struts relative to the rear deck 16. Each chain 88 includes a load binder 90 coupled to a chain for adjusting its effective length. Each strut is coupled to a clevis carried by the rear cantilever support base portion 74B. The struts and chains are preferably disconnected and stashed aboard the trailer during transport.

Erection of the mast 50 to the upstanding, elevated workover position is preferably carried out by rotating the mast support substructure 52 from its reclining transport position to its fully extended upright position while the mast 50 remains in its reclining position. After the mast support substructure has been fully stabilized in the upright position, the hydraulic lift cylinders 80 are actuated to cause the mast 50 to be pivoted to its upright standing position on the cantilever support base 74. The hydraulic lift cylinders 78, 80 are continuously pressurized in order to further stabilize the mast support substructure and transmit mast loads to the trailer platform 16. Retraction of the mast 50 is carried out in the reverse order by first uncoupling the rear leg portions at the clevis 72 and retracting the double acting hydraulic lift cylinders 80 until the mast 50 is substantially horizontal. Thereafter, the hydraulic lift cylinders 78 are retracted until the mast support substructure is resting in its reclining transport position with the upper end of the mast resting on the tie-down bar 47.

Draw Works 14

Referring now to FIGS. 1–4 and FIGS. 10 and 11, the principal components of the draw works 14 are the traveling block 58, a linear hydraulic actuator 92, a hoist power transmission system 94 and a snub power transmission system 96.

Figure 4:
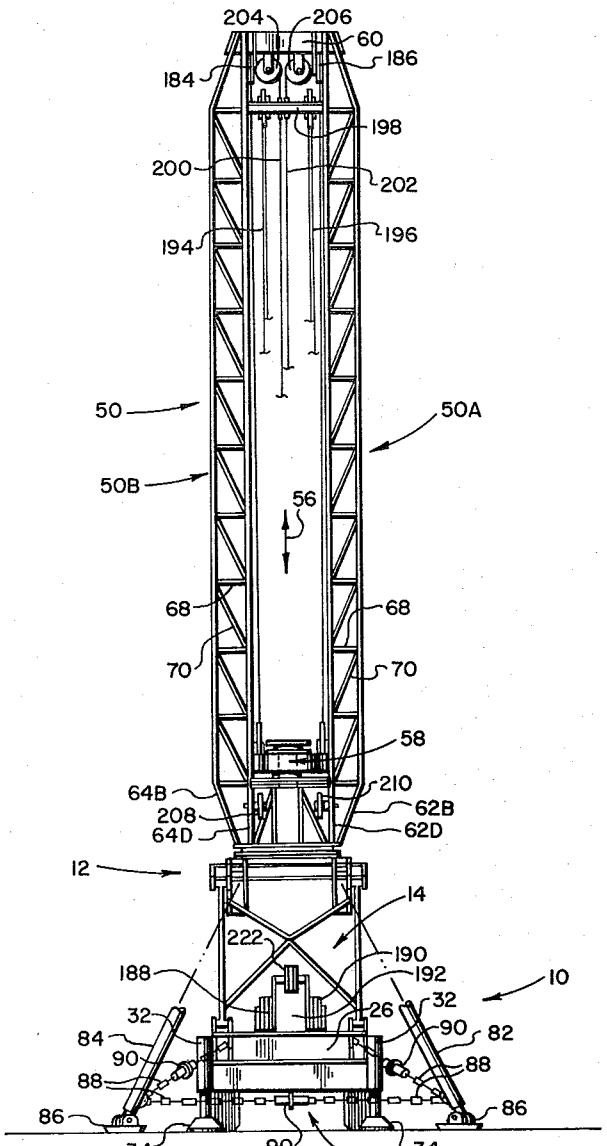
FIG. 4 is a front elevational view of the workover rig with the mast standing in the fully erect position.

The traveling block 58 is guided for vertical displacement along the rear legs 62A, 64D, which serve as guides, as can best be seen in FIGS. 4 and 23. The traveling block 58 includes a main cross member 98 which extends horizontally between the legs 62D, 64D and is provided with guide rollers 100 rotatably mounted about shafts 102 at either end of the frame. The periphery of each roller is concave to conform to the shape of the tubular members 62D, 64D and vertically guide the traveling block as it is reciprocated along the mast 50. A rotary table 104 is carried by the main cross member 98 of the traveling block to facilitate workover or drilling operations.

The construction of the rotary table 104 is well known and includes a spindle 106 which is mounted for rotation in bearings 108 and is driven by a hydraulic motor 110 through a chain drive 112 coupled to its output shaft. The spindle 106 carries a flange 114 which supports a pipe gripping assembly 116 consisting of a slip bowl 118 and a snubber bowl 120 concentrically aligned to engage a length of pipe string extending through the central opening of the spindle 106. These fixtures are well known in the art and generally include a conical bowl having a set of pipe slips or jaws which are adapted to grip the periphery of the pipe string. The pipe gripping jaws can be moved into or out of engagement with the pipe surface by a hydraulic piston or by other power means. The slip bowl 118 is designed having its jaws 122 adapted to engage pipe string to prevent the weight of the pipe from causing the pipe to slip into the well hole. The snubber bowl 120 is equipped with jaws 124 which are adapted to engage the pipe to secure it against upward displacement, as for example, to restrain the pipe string against the well pressures, or for driving the pipe string when it is being pushed into a hole. The slip bowl and snubber bowl can be remotely operated by control means located for operator access at the operator platform 126 mounted on the mast 50 (FIG. 1). The power to raise and lower the traveling block 58 is provided by the linear hydraulic actuator 92 which is transmitted to the traveling block by the hoist and snub power transmission systems 94, 96, which will now be described.

Referring to FIGS. 3, 4, 10, 11 and 19–21, the linear hydraulic actuator 92 is carried on the rear deck 24 of the trailer platform 16 and includes rod and cylinder housing elements 128 and 130, respectively. The rod element 128 is rigidly attached at one end to an anchor weldment 132 whereby the actuator assembly 92 is supported in spaced, parallel relation with the rear deck 24 so that the cylinder housing 130 can move freely in extension and retraction. Reciprocal movement of the cylinder 130 is stabilized by the guide tube 48 which receives the freely projecting end of the cylinder housing 130. The anchor weldment 132 includes a socket for engaging a threaded shaft portion 134 of the rod element 128.

The linear hydraulic actuator 92 is double acting and includes a piston 136 slidably received within the cylinder housing 130 which partitions the interior of the cylinder housing into head and rod chambers 138 and 140, respectively. The rod element 128 comprises two concentric tubes 142, 144 for circulating hydraulic fluid into the head chamber 138 and rod chamber 140, respectively. The inner rod tube 142 has a bore 146 which connects the head chamber 138 in fluid communication with a stepped concentric blind bore 148 which communicates with a lateral hydraulic flow passage 150. Similarly, a lateral flow passage 152 communicates with an annular passage 154 which extends intermediate the inner rod tube and the outer rod tube. Hydraulic fluid discharged through the annular flow passage 154 circulates through discharge ports 156 which communicate with the rod chamber 140. Appropriate O-ring seals 158, 160 seal the pressure chambers against fluid leakage. An end cap 162 blocks off the end of the cylinder housing 130. It will be seen, therefore, that the piston rod element 128 remains fixed to the anchor weldment 132 so that pressurization of either the head or rod chamber of the cylinder housing 130 will cause the cylinder housing to extend or retract.

The guide tube 48 extends aft from the power unit 40 in concentric alignment with the cylinder housing 130. Guide plates 165 carried on the forward end of the cylinder engage the bore surface 167 of the guide tube 48 at opposite sides. The guide plates serve to slidably guide and stabilize the cylinder housing 130 as it extends and retracts in response to pressurization of the head and rod chambers. A guide bracket 163 carries the guide plates 165 in the annulus between the guide tube and cylinder element.

Mounted on the aft end of the cylinder housing 130 is a trunnion weldment 164 which carries horizontally extending trunnions 166, 168 and vertical trunnions 170, 172. Hoist traveling sheaves 174, 176 are journalled for rotation on sheave bearings 178 which are coupled to the horizontal trunnions 166, 168, respectively. Snub traveling sheaves 180, 182 are similarly journalled about the vertical trunnions 170, 172, respectively. The rotational axis of the hoist traveling sheaves is preferably perpendicular to the axis of the snub traveling sheaves.

The reeving engagement of the hoist transmission system and the snub transmission system will not be described in connection with FIGS. 3, 10 11 and 21. The hoist power transmission system 94 applies a lifting force to the traveling block 58 which is developed by the linear hydraulic actuator 92, and also serves to transfer the load engaged by the traveling block 58 onto the mast 50. These functions are made possible by a pair of crown hoist sheave assemblies 184, 186 journalled in laterally spaced relation on the crown block 60 near the top of the mast 50. Base hoist sheaves 188, 190 are journalled near the bottom of the mast on a base sheave weldment 192 which is anchored to the tailboard 26, the aft deck 24 and the rod anchor weldment 132. Carried in reeved engagement with the crown hoist sheaves and the base hoist sheaves are hoist cable pairs 194, 196 which are firmly attached at one end to the top side of the traveling block 58 with the opposite end portions anchored to the base platform and tailboard. An intermediate length of each cable pair is extended upwardly along the mast, passing around the crown hoist sheaves 184, 186, respectively, extending downwardly along the mast and passing around the base hoist sheave assemblies 188, 190, respectively, extended forwardly along the aft dect 24 in parallel with the stroke pathway of the cylinder housing 130, passing around the traveling hoist sheave assemblies 174, 176, respectively, thence passing aft along the aft deck 24 and passing around the base hoist sheave assemblies 188, 190, respectively, and thence passing around the traveling hoist sheave assemblies once again thereby defining a multiple purchase of 4:1. In this arrangement, displacement of the cylinder housing will drive the traveling block a greater proportional distance through the load transport zone 56, thereby multiplying the stroke effect of the linear hydraulic actuator 92. For this arrangement, a nine foot stroke of the traveling sheaves is translated into a thirty-six foot traveling block stroke.

A traveling cross bar 198 interconnects the downwardly extending hoist cables at a common length from the traveling block, and also interconnects the upperwardly extending snub cables 200, 202 at a common length from the traveling block, whereby the hoist and snub cables are anchored together for concurrent movement relative to each other. The snub power transmission system includes crown snub sheave assemblies 204, 206 which are jounalled near the top of the mast on the crown block 60 intermediate the laterally spaced crown hoist sheaves. The crown hoist sheaves and the crown snub sheaves are journalled about axes which are mutually perpendicular, with the axes of the crown hoist sheaves being in axial alignment, and the axes of the crown snub sheaves extending in parallel with each other. The crown snub sheaves are centered with respect to the crown hoist sheaves whereby the hoist and snub cables on the forward side of the mast are substantially coplaner with each other. The snub cables 200, 202 are connected to the under side of the traveling block 58 and extend around base snub sheaves 208, 210 which are journalled on the mast sections 50B and 50A, respectively. The opposite ends of the snub cables 200, 202 are attached to an anchor block 212 which is secured to the guide tube 48 forward of the position reached by the traveling snub sheave assembly at the limit of its travel in extension.

An intermediate length of each snub cable extends downwardly from the traveling block along the mast, passing around the base snub sheave assemblies 208, 210, thereafter extending forwardly in passing around a second group of base snub sheaves 214, 216 which are also journalled on the mast sections 50A, 50B. After passing around the base snub sheaves 214, 216, the snub cables 200, 202 extend upwardly and connect onto the traveling cross bar 198 in alignment with the hoist cables, and continue upwardly on the top side of the traveling cross bar along the mast in parallel with the hoist cable pairs and passing around the snub corwn sheaves 204, 206, thereafter extending downwardly along the mast again in parallel with the hoist cable means.

The traveling cross bar is provided with a pair of through holes 218, 220 through which the downward run of the snub cables 200, 202 passes without interference downwardly along the mast and in parallel with the hoist cables and passing around a base snub sheave assembly 222 which is journalled on the base sheave weldment 192. Thereafter, the snub cables 200, 202 extend forward along the aft deck and pass around a first platform snub sheave assembly 224, extending aft along the platform in passing around the traveling snub sheave assembly 180, extending forwardly along the platform in a parallel run to a second base snub sheave assembly 226 and thence aft along the platform and passing around the traveling snub sheave 182 and extending forwardly again along the base platform to the snub anchor 212, thereby defining a multiple cable purchase which corresponds to the hoist cable purchase. The platform snub sheaves and snub anchor are located forward of the position reached by the traveling snub sheave assembly at the limit of its travel and extension whereby the traveling block is reciprocated along the mast in response to extension and retraction of the cylinder housing relative to the stationary rod 128.

It will be seen that when the head end of the cylinder 130 is pressurized to move the cylinder and traveling sheaves forwardly along the platform 16, the traveling block 58 will be raised, guided on the rollers 100 along the mast legs 62D, 64D. Conversely, when the cylinder housing 130 is oppositely pressurized to cause the cylinder housing to retract, that is move along the platform toward the tailboard 26, the traveling block 58 will be caused to lower on its rollers as a downward pull is exerted on the parallel snub cables 200, 202.

Extension and retraction of the cylinder housing 130 is controlled from the operator platform 126 which is horizontally supported from the aft legs of the mast at an elevation convenient for workover operations. The forward part of the platform (not shown) houses hydraulic valves that control the actuation of the various components as will be explained.

Adjustable Stack Connector 228

The construction of the adjustable stack connector 228 will be explained with reference to FIGS. 13–17. The vertically adjustable stack connector 228 is provided for accomodating the existing elevation of well head flange connections. Because of the variability in the elevation of existing well head flange connections, some adjustable means must be provided for interconnecting the mast support substructure 74 to the well head flange. The vertically adjustable stack assembly 228 carries out this function, as well as simultaneously anchoring the trailer platform 16 to a well casing, thereby stabilizing the mast and mast support substructure. This arrangement helps stabilize the mast for free-standing operation on the cantilever support base and for transmitting mast load reaction forces through the trailer platform, thereby eliminating the need for dead man anchor lines which would otherwise be required for stabilizing the mast and for reacting dynamic mast loads.

Figure 16:
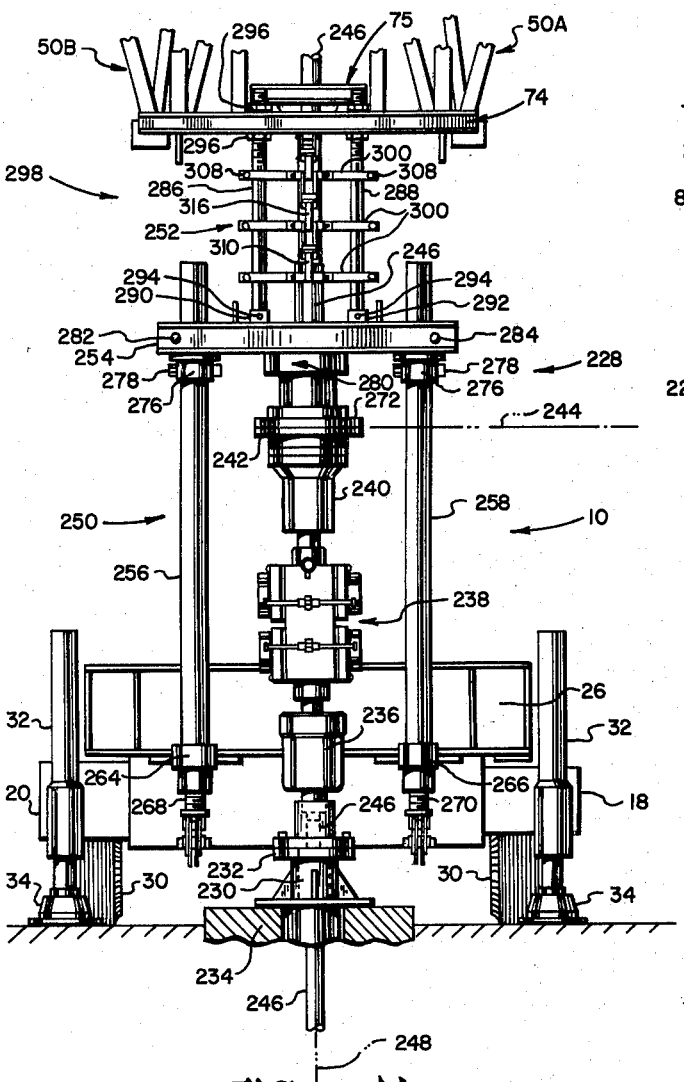
FIG. 16 is a front elevation view of the completed vertically adjustable stack assembly shown interconnecting the mast support substructure and the rig support platform with the flanged connector of a well head assembly.
Figure 17:
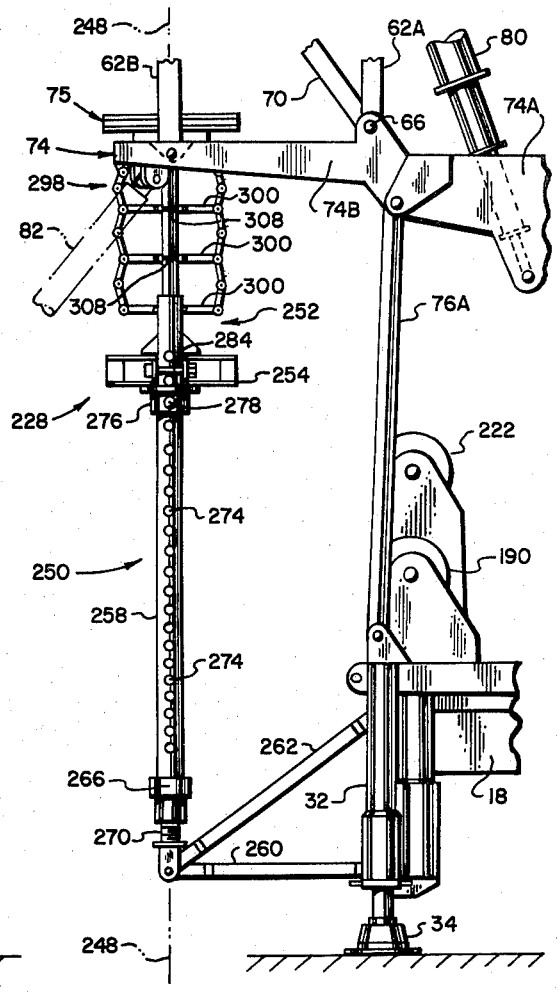
FIG. 17 is a simplified side elevation view of the stack assembly shown in FIG. 16.

Referring now to FIG. 16, the workover rig 10 is set up adjacent a well site in which a well casing 230 is terminated by a lower well head flange 232 and is anchored by a concrete block 234 in the usual manner. As is conventional, a blow out preventer 236 is located above and connected to the lower well head flange 232. A slip 238 is located above and connected to the blow out preventer 236. Located above and connected to the slip is an energizable packer 240. The packer is coupled to an upper well head flange 242 disposed at an elevation above the trailer platform as indicated by the elevation reference line 244. The BOP slip and packer are all concentrically aligned with the well casing 230 so that a tubing string may be moved upwardly through the well casing along the bore axis 248 as the tubing string is run out of the well. Conversely, when running the tubing string 246 into the well, each section is moved downwardly through the packer, slip and blow out preventer into the well casing 230.

The blow out preventer 236 may be of any suitable type, but is preferably hydraulically energizable for engaging the tubing string 246 in a fluid sealing relation to prevent the well from blowing out. The slip 238 may also be of any suitable construction and is preferably double acting, i.e., is preferably capable of preventing both upward and downward movement of the production tubing string. The packer 240 may not be present on some well head installations, in which case the upper well head flange 242 is located at a different elevation. The precise elevation of the well head flange termination 242 varies from well to well depending upon the length of the well head equipment which is used for terminating the well. This variation in the elevation of the well head flange presents a problem for conventional portable workover rigs since the traveling block must be consentrically aligned with the well bore, and since it is generally desirable to interconnect the mast support substructure to the well casing to transfer the static weight of the mast from the mast support substructure to the well casing. As previously explained, it is also desirable to anchor the rig platform to the well casing to stabilize the free-standing mast and mast support substructure against wind loading and dynamic reaction forces developed during pipe running operations.

These functions are carried out by the vertically adjustable stack assembly 228 which includes a lower adjustable support column assembly 250 anchoring the trailer platform 16 to the well head casing 230, and an upper adjustable support column assembly 252 which is interposed between the well head casing 230 and the mast support substructure to the well casing. In this arrangement, the vertically adjustable stack assembly 228 simultaneously anchors the trailer platform to the well head casing, thereby stabilizing the mast support substructure while transferring the burden of the mast from the intermediate mast support substructure. This arrangement helps stabilize the mast 50 for free-standing operation on the mast support substructure and for transmitting mast load reaction forces through the trailer platform 16.

The lower support column assembly comprises a horizontal cross beam 254 which is adjustably connected to first and second upright support columns 256, 258 which are spaced in parallel with each other on laterally opposite sides of the flange connector 242. First and second struts 260, 262 project from the tailboard 26 of the trailer platform 16 for supporting the support columns 256, 258 in parallel alignment with the bore axis 248. The lower end of each support column 256, 258 is furnished with a threaded collar 264, 266, respectively, in which threaded posts 268, 270 are received in telescoping engagement. Because of this threaded, telescoping engagement, the effective length of the support columns is adjustable to drive a stack flange connector 272 carried by the cross beam 254 into compressive engagement with the well head flange connector 242. The stack flange connector 272 and the upper well head flange 242 each have through holes which are aligned for securely fastening the cross beam to the well head.

The first and second support columns 256, 258 each have a plurality of holes 274 extending through their walls in equally spaced relation along the length of the columns. The horizontal cross beam 254 carries fastener collars 276 which are similarly equipped with through holes and which are disposed in sliding engagement around the support columns. Stay pins 278 are disposed in registration engagement with the aligned through holes of the support columns and fastener collars for securing the cross beam 254 at an elevation which closely matches the elevation of the well head flange 242. The cross beam 254 is further secured by fastener bolts 282, 284 in a clevis coupling arrangement on both support columns. Exact engagement of the stack flange connector 272 with the well head flange connector will usually not be obtainable by merely adjusting the elevation of the cross beam 254. After the cross beam has been set as closely as is possible by adjusting its elevation with the collar and stay pins, the threaded collars 264, 266 are rotated while the threaded posts 268, 270 are held stationary by the struts thereby drawing the stack flange connector 272 into compressive engagement with the well head flange connector 242. The support columns 256, 258 undergo tension loading which firmly anchors the trailer platform 16 to the well head.

The cross beam 254 is preferably equipped with an annular stripper bowl 280 coaxially disposed and connected to the stack flange connector 272 for resiliently engaging the inner pipe string 246 and sealing the annulus between the casing 230 and the pipe string. The stack flange connector 272 is supported in downwardly depending relation from the stripper bowl 280 as can best be seen in FIG. 13.

The upper support column assembly 252 is also vertically adjustable in order to transfer the weight of the mast from the cantilever support substructure 74 to the well casing 230. The upper support column assembly 252 comprises generally first and second upright support columns 286, 288 connected intermediate the cross beam 254 and the cantilever support substructure 74 on laterally opposite sides of the stack flange connector 272. The intermediate length of these upright support columns is vertically adjustable after the stack flange connector 272 has been secured to the well head flange connector 242 so that the weight of the mast 50 will be transferred from the cantilever support substructure 74 to the well casing 230. Sockets 290, 292 are anchored to the top side of the cross beam 254 on laterally opposite sides of the stripper bowl 280 for receiving the upright support columns 286, 288, respectively. The support columns are fastened in the sockets by means of through bolt and cap nut combinations 294. The upper ends of the upright support columns 286, 288 are threaded and project through the cantilever support substructure on opposite sides of the stationary slip bowl 75. The cantilever support base is connected to the upright support columns by means of lock nuts 296 tightened against the cantilever support base on both the top and bottom sides thereof. It is generally desirable to tighten the bottom lock nuts against the cantilever support base 74 to cause compression loading in the support columns 286, 288, so that the static load of the mast will be substantially transferred from the cantilever support substructure 74 to the well head casing 230. The upper lock nuts are also tightened so that upwardly directed snubbing loads will be transmitted through the adjustable stack connector assembly 228 to both the well head casing 230 and the trailer platform 16.

Pipe String Bolster Assembly 298

Figure 12:
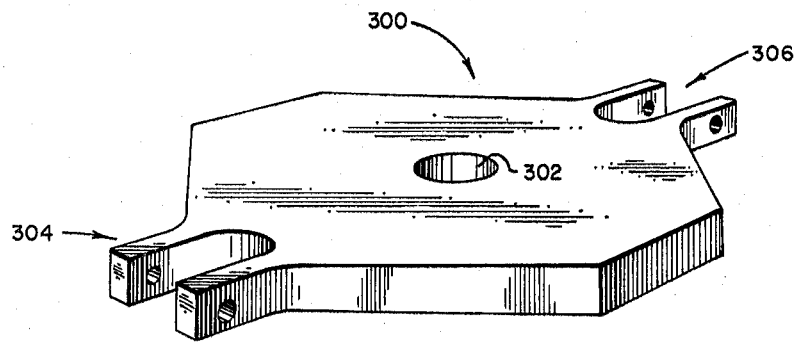
FIG. 12 is a perspective view of a bolster plate assembly which is used in a combination shown in FIG. 16.
Figure 13:
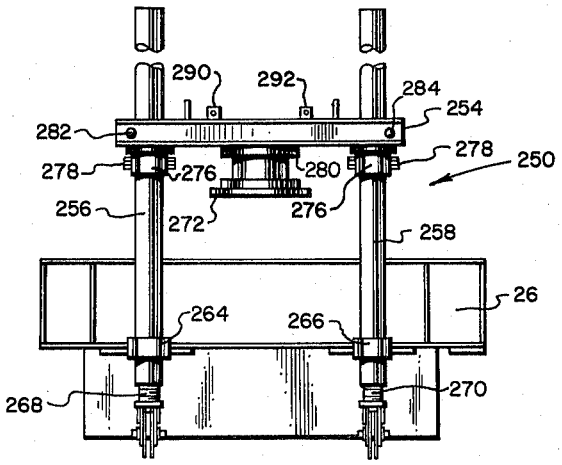
FIG. 13 is a front elevation view of a part of a vertically adjustable stack assembly.
Figure 14:
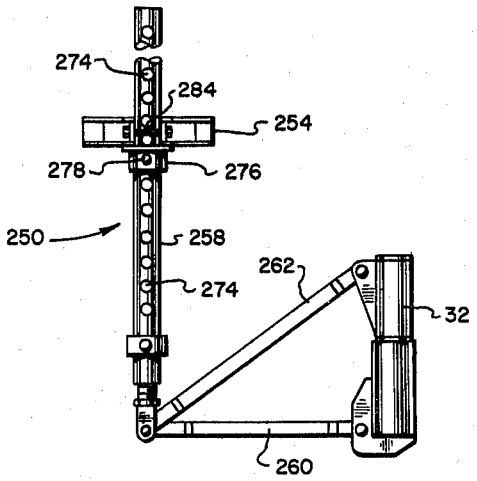
FIG. 14 is a side elevational view of the vertically adjustable stack assembly shown in FIG. 13.
Figure 15:
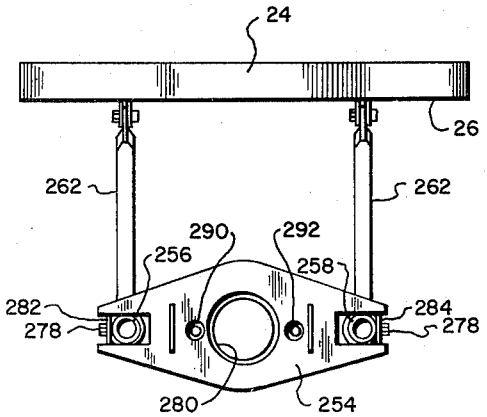
FIG. 15 is a top plan view of the vertically adjustable stack assembly shown in FIG. 13.
Figure 18:
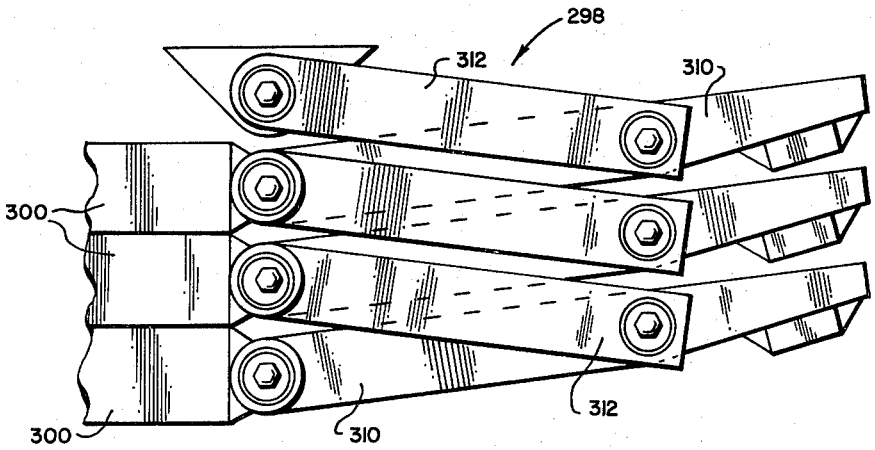
FIG. 18 is a partial elevation view of a bolster assembly in a fully retracted configuration.
Figure 19:
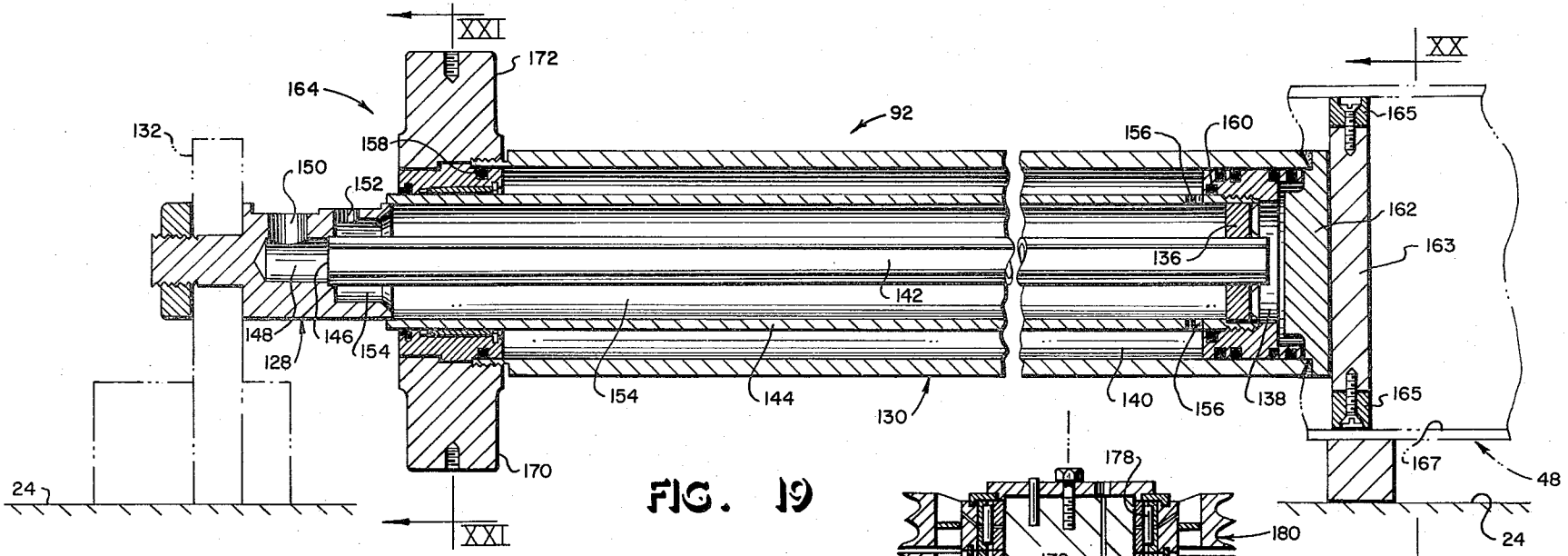
FIG. 19 is a longitudinal sectional view of a linear hydraulic actuator which powers the draw works shown in FIG. 1.
Figure 21:
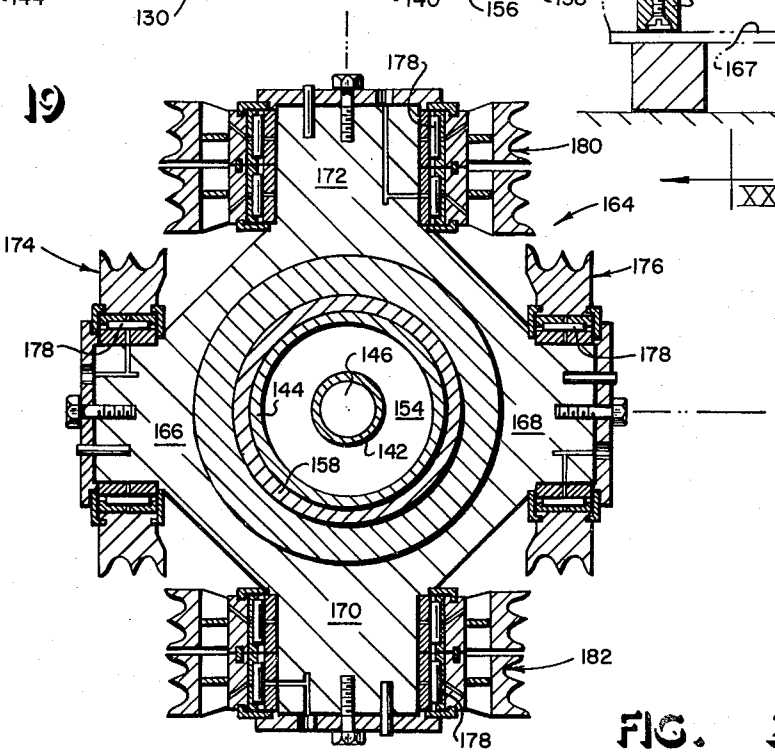
FIG. 21 is a sectional view taken along the line XXI—XXI which illustrates the assembly of traveling sheaves on trunnions.
Figure 20:
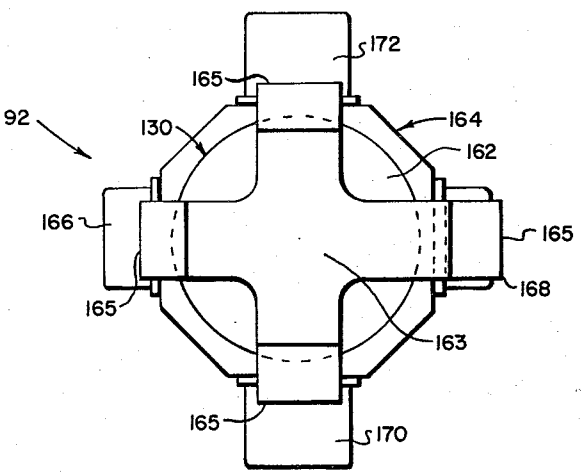
FIG. 20 is an elevation view of the linear hydraulic actuator which illustrates the relative position of trunnions with sheaves removed, taken along the line XX—XX of FIG. 19.

The distance separating the mast support substructure and the well head flange may in some cases be too long to support compressive loading without buckling. During snubbing and drilling operations, the intermediate length of pipe string undergoes severe compressive loading, which may cause buckling of the intermediate pipe string section unless it is supported in some way. Referring now to FIGS. 12, 16 and 18, a bolster assembly 298 is attached to the upper support column assembly 252 for providing lateral support for a length of inner pipe string 246 extending between the cantilever base support substructure 74 and the well head flange 242. The bolster assembly 298 comprises a plurality of bolster plates 300 each having a central opening 302 for receiving and passing the intermediate length of pipe string 246.

The bolster plates are provided with clevis fasteners 304, 306 for engaging the upright support columns 286, 288, respectively. Clevis bolts 308 secure the clevis fasteners to the upright support columns at a plurality of vertically spaced locations and intermediate the mast and the stack flange connector. Link elements 310, 312 are interconnected in a scissors arrangement on opposite sides of the bolster plates for permitting accordion-like movement of the bolster plates relative to each other in parallel stacked relation. When the intermediate length of pipe string 246 is received through the concentrically aligned openings 302, the vertically spaced bolster plates 300 cooperte to oppose radial deflection of the pipe string in response to severe compression loading. The link elements 310, 312 are pivotally suspended from the under side of the cantilever support base 74 and are anchored in place in spaced relation along the upper support columns by the clevis bolt fasteners. Any suitable number of bolster plates may be stacked, with the bolster spacing preferably being approximately one foot.

Powered Drill Sub 314

Turning now to FIGS. 22, 23 and 24, the powered drill sub assembly 314 is provided for carrying out drilling operations in combination with the transportable mast assembly 12 and draw works 14. The powered drill sub assembly 314 includes a drill sub 316 which is supported in vertically yieldable engagement with the traveling block 58 by means of a stab assembly 318. The purpose of the vertically yieldable stab assembly 318 is to permit vertical displacement of the drill sub relative to the traveling block during make-up and break-out operations while reacting torque forces which are produced by the operation of the powered drill sub. The stab assembly 318 comprises first and second upstanding stab receptacles 320, 322 anchored to the top side of the main cross member 98 and on laterally opposite sides of the pipe gripping assembly 116. The stab receptacles are disposed for engagement with stab elements 324, 326 which are supported for vertical reciprocal movement between retracted and extended positions. The stab elements depend downwardly from the under side of a cross beam 328, which is suspended above the traveling block by auxiliary hoist lines 327, 329. Centrally mounted on the cross beam 328 is the power drill sub 316.

Each stab element includes a tubular housing 330 anchored to the cross beam, and a stanchion 332 anchored to the cross bar and projecting through the tubular housing 330. A tubular piston 334 is telescopically received in overlapping engagement with the tubular housing 330. A spring 336 is coiled around the stanchion and anchored to the cross beam 328 and on its opposite end to the tubular piston for biasing the piston to its fully extended position. A stab rod 338 projects from the piston 334 for stabbing engagement with the stab receptacle. The stab rod is provided with a cavity 340 for receiving the lower end of the stanchion 332 when the piston 334 is fully retracted. A radially projecting collar 342 is secured to the piston near the union of the piston and stab rod for engaging the top of the stab receptacle.

The drill power assembly 316 includes a drill sub 334 having a threaded pin connection 346 for engaging a box connection on the upper end of the pipe string 246. A hydraulic motor 348 is coupled to the drill sub for rotating it and the connected drill string in response to the flow of hydraulic fluid through a hydraulic connector 350. The drill sub 344 is journalled in a rotary bearing assembly 352. The threaded pin connection is enclosed by a stab guide housing 354 with the opposite end of the drill sub communicating with a fluid swivel connector 356. A BOP 358 rides on top of the swivel connector 356 and is coupled to a mud line 360 for circulating drilling fluid through the drill sub 316 and into the attached drill string as the drill sub is rotated.

The cross beam 328 is fitted with guide hooks 362, 364 for engaging the hoist cable pairs 194, 196, respectively.

Skid Mounted Rig For Offshore Operations

Figure 5:
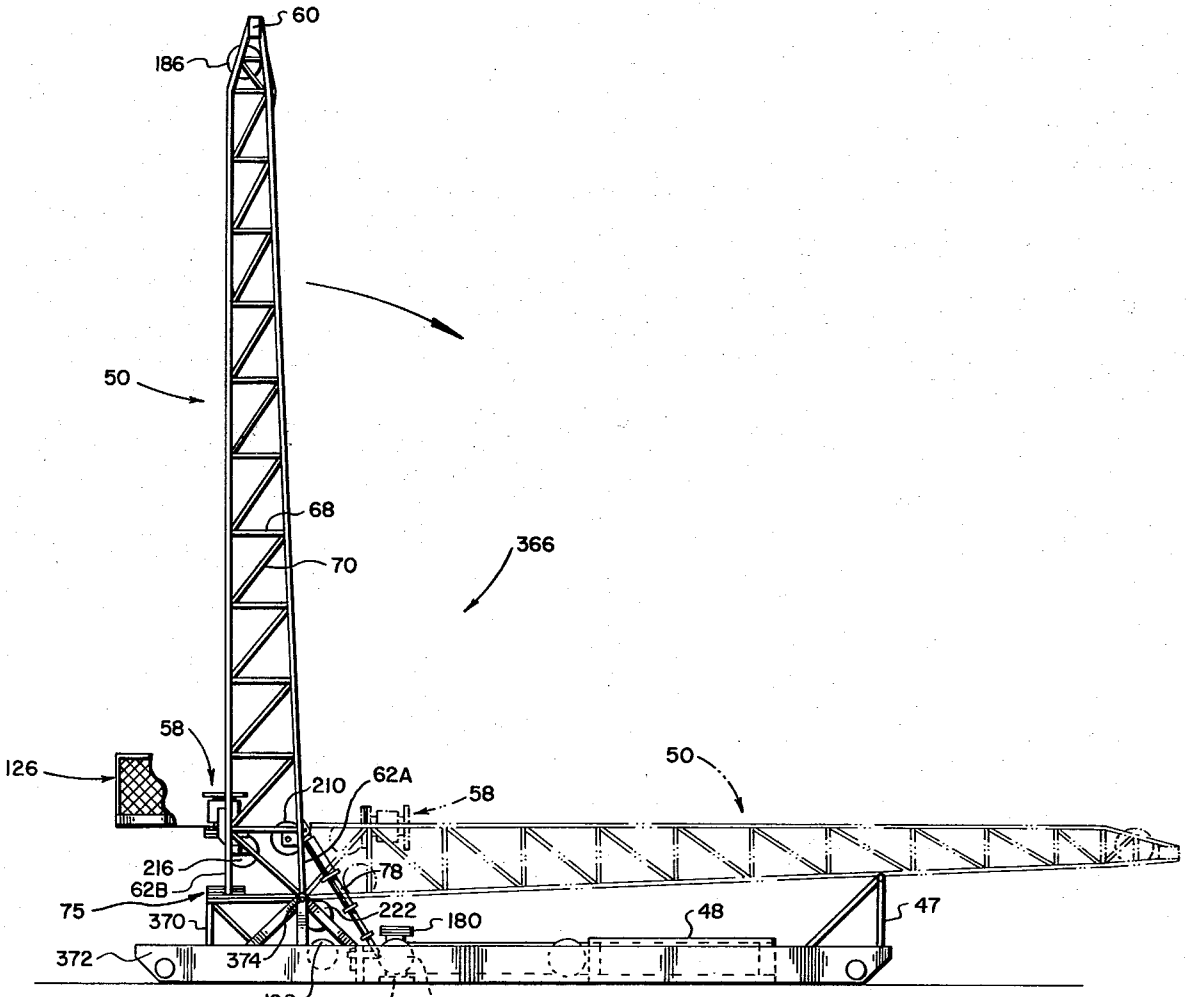
FIG. 5 is a side elevational view of a skid mounted workover rig having draw works constructed according to the teachings of the present invention.
Figure 6:
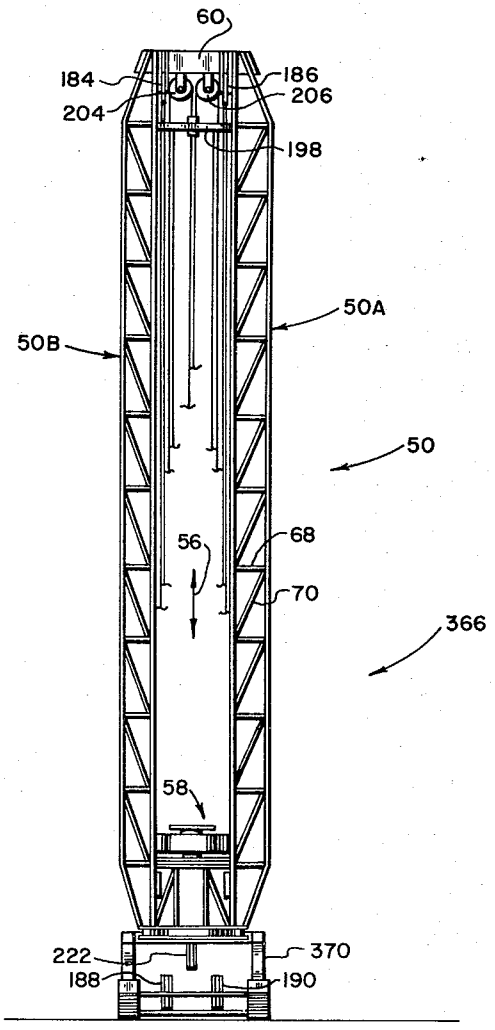
FIG. 6 is a front elevational view of the skid mounted workover rig shown in FIG. 5.
Figure 10:
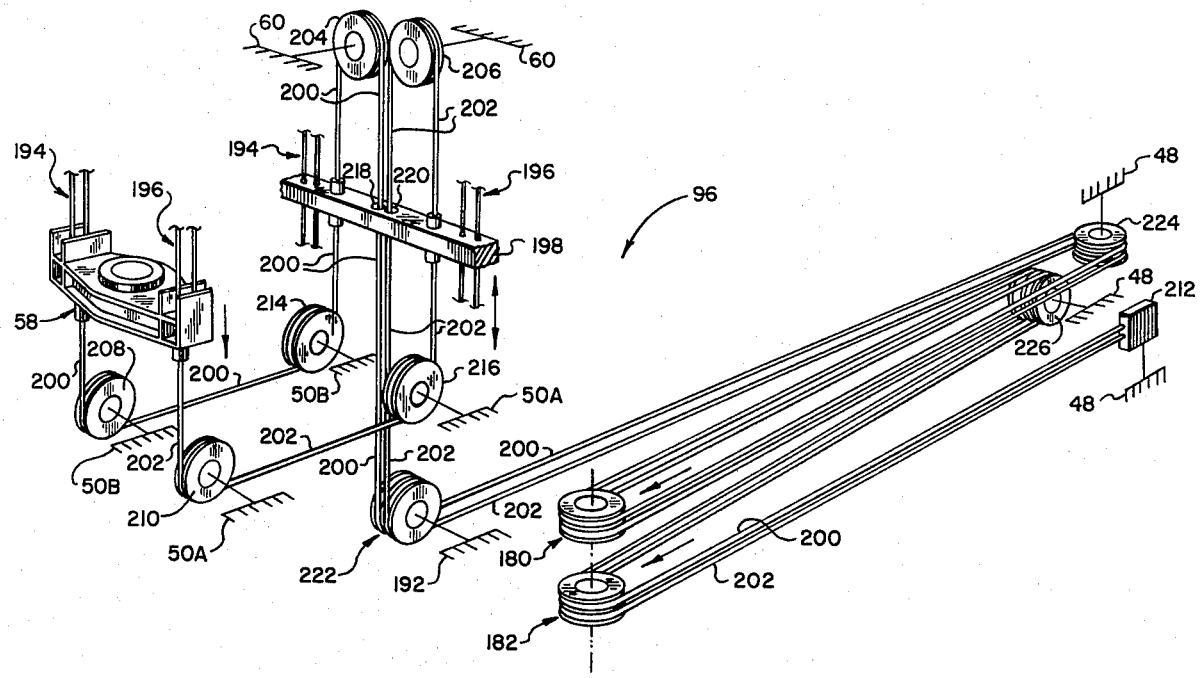
FIG. 10 is a perspective view which illustrates the arrangement of sheaves and reeving of cables for conducting snubbing operations on the workover rig shown in FIG. 1.
Figure 11:
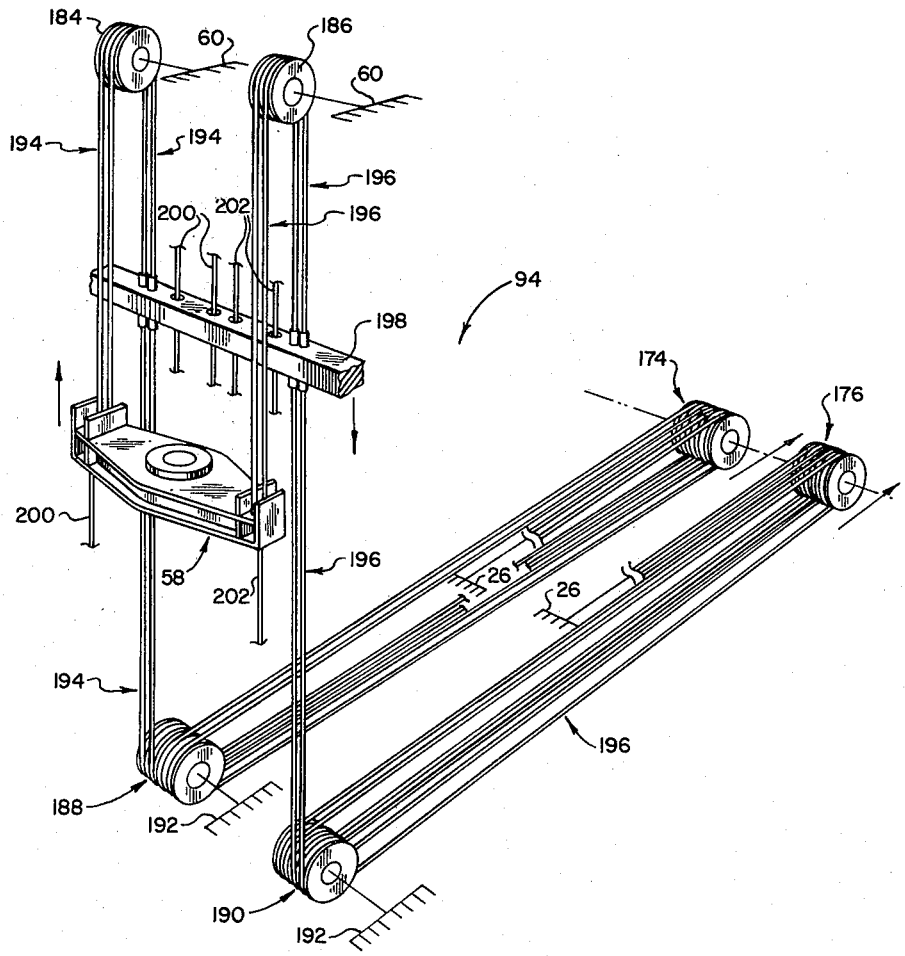
FIG. 11 is a perspective view which illustrates the arrangement of sheaves and reeving of cables for conducting hoist operations on the workover rig shown in FIG. 1.

When it is desired to work over an offshore well, the skid mounted transportable mast and draw works assembly 366 as shown in FIGS. 5 and 6, or alternatively, the skid mounted mast and draw works assembly 368 as illustrated in FIGS. 7, 8 and 9 is employed. In these arrangements, accessory equipment such as tools, power pack, pumps and other equipment are separately transported. Turning now to FIG. 5, the mast 50 is pivotally coupled to a mast support substructure 370 which is mounted on one end of a skid 372. The skid 372 is transported on a barge and when arriving at the offshore well, a heavy duty utility crane raises the skid mounted workover rig 366 on to the offshore platform adjacent the well head. The mast 50 is erected about a hinge pin 374 which is pivotally connected to the rear legs of the mast. A hydraulic lift cylinder 78 pivotally coupled between the skid and the mast drives the mast in rotation about the hinge pin 374 until the forward legs 62B of the mast are brought to a standing position on the mast support substructure 370 and locked into place by a suitable fastener. The hydraulic system is then connected to the power pack 40 which may be located at any convenient remote location.

Referring to FIG. 9, the skid 372 is formed by left and right side beams 376 attached to opposite sides of a structurally reinforced below-deck 378. The below-deck supports the linear hydraulic actuator 92 with the cylinder housing 130 being shown received within the guide tube 48. A super-deck 380 is anchored to the below-deck and is supported at an elevation above the linear hydraulic actuator and the associated sheave assemblies. Safety rails 382, 384 extend along the length of the super-deck on opposite sides thereof, and a pipe rack is secured to the super-deck intermediate the safety rails, thereby defining walkways 388, 390 intermediate the safety rails and the pipe rack. In the transport mode, the mast is carried in the pipe rack 386, and during workover operations pipe sections are stored in the pipe rack.

Although preferred embodiments of the invention have been described in detail, it should be understood that various changes, substitutions and alterations can be made therein without departing from the spirit and scope of the invention as defined by the appended claims.

What is claimed is:

1. A transportable mast assembly for a workover rig comprising:

a portable rig support platform;

a mast supported substructure including a cantilever support base projecting beyond the support platform in a workover position;

an elongated mast pivotally mounted on the mast support substructure for movement from a reclining transport position overlying the rig support platform to an erect workover position overlying and engaging the support base;

the mast including pipe engaging means movable along the mast for engaging and hoisting a pipe string;

a mast carriage assembly mounted on the support platform and connected to the mast support substructure for moving the mast support substructure between the transport position and the workover position wherein the support base projects above and beyond the support platform;

first power means operatively coupled intermediate the support platform and the carriage assembly for selectively moving the mast support substructure from the transport position to the workover position to place the support base over a wellhead; and, second power means operatively coupled intermediate the mast support substructure and the mast for selectively erecting the mast from the transport position to the erect workover position whereby the pipe engaging means may be operated to engage and hoist a pipe string from the wellhead.

2. The mast assembly as defined in claim 1, the mast carriage assembly comprising first and second pairs of lift arms coupled in parallel relation to each other intermediate the mast support substructure and the rig support platform, each lift arm being pivotally connected at opposite ends to the mast support substructure and the rig support platform, respectively, the combination of each pair of lift arms with the mast support substructure and the rig support platform defining a parallelogram throughout the range of movement of the mast support assembly from the transport position to the workover position.

3. The mast assembly as defined in claim 1, the first and second power means each comprising a hydraulic cylinder assembly having piston and rod elements, the cylinder and rod element of the first power means each being pivotally connected to the rig support platform and the mast support substructure, respectively, and the cylinder and rod element of the second power means each being pivotally connected to the mast support structure and the mast, respectively.

4. In a hoist rig of the type including a portable rig support platform and an elongated mast, the combination with the rig support platform of apparatus coupled intermediate the rig support platform and mast for erecting the mast from a substantially horizontal transport position overlying the rig support platform to an upright hoist position overlying an operating zone, the erection apparatus comprising a cantilever support base coupled in pivotal engagement with the base of the mast, first and second pairs of lift arms coupled in parallel relation to each other on laterally opposite sides of the cantilever support base with each lift arm being pivotally connected at opposite ends to the rig support platform and the cantilever support base, respectively, the combination of each pair of lift arms with the cantilever support base and rig support platform defining a parallelogram for maintaining the cantilever base in parallel alignment with the rig support platform throughout its range of movement from the transport position to the upright hoist position.

5. A transportable mast assembly comprising, in combination:

a trailer having a load bearing frame including a rear deck for supporting hoist operations and a forward deck having a coupling member for towing engagement with a tractor;

an elongated mast having a base portion and a crown portion;

an intermediate support base including a carriage assembly and a cantilever portion projecting from the carriage assembly;

means coupled intermediate the rear deck and the carriage assembly for moving the intermediate support base from a transport position in generally parallel alignment with and overlying the rear deck to an elevated operating position in generally parallel alignment with the rear deck wherein the cantilever portion is extended beyond the tailboard of the rear deck;

means connecting the base portion of the mast in hinged engagement with the cantilever portion for permitting pivotal movement of the mast from a reclining transport position overlying the rear and forward decks to an erect hoist position extending above and resting in load bearing engagement upon the cantilever portion; and, means coupled intermediate the carriage assembly and the base section of the mast for driving the mast in pivotal movement about the hinge means from the reclining transport position to the erect hoist position.

6. The transportable mast assembly as defined in claim 5 including an upstanding tie-down bar connected to the forward deck for engaging the mast at a point intermediate the crown and base sections and for supporting the crown section in spaced relation with the forward deck when the mast is disposed in the reclining transport position.

7. The transportable mast assembly as defined in claim 5 including first and second struts having ground engaging stabilizer pads coupled in hinged engagement with the cantilever portion of the intermediate support base, first and second chains connected intermediate the load bearing trailer frame and the struts, respectively, a third chain connected intermediate the first and second struts, and means coupled to each chain for adjusting its effective length.

8. The transportable mast assembly as defined in claim 5 including first and second pairs of ground engaging jacks secured to the forward and rear decks, respectively, for stabilizing the load bearing frame of the trailer during hoist operations.

9. The transportable mast assembly as defined in claim 5, the elongated mast comprising first and second mast sections each having base and crown portions, and a crown block interconnecting the crown portions, the first and second mast sections being laterally spaced with respect to each other thereby defining a load lifting zone intermediate the mast sections, the base portions each having forward and rear legs which are structurally interconnected, the forward legs of each mast section being connected in hinged engagement on opposite sides of the cantilever portion, and the rear legs being disposed for load bearing engagement upon the cantilever portion when the mast is erected to the upstanding hoist position.

10. Drawworks for lifting a load comprising:

a base platform;

a mast standing erect on the base platform;

load engaging means disposed for reciprocal movement through a vertical load lifting zone intermediate the base platform and the top of the mast;

a power transmission system for raising and lowering a load transported by the load engaging means including first and second cable systems coupled intermediate the load engaging means and the base platform, fixed sheave means mounted on the mast engaging the cable systems and guiding the load engaging means through the load lifting zone, and traveling sheave means engaging the first and second cable systems, respectively, and mounted for movement along the base platform through a stroke pathway which extends transversely with respect to the load lifting zone, whereby the load engaging means moves in response to movement of the traveling sheave means; and, extensible linear actuator means carried on the base platform having rod and housing elements, one of the elements being anchored to the platform and the other element carrying the traveling sheave means through the transverse stroke pathway for displacing the load engaging means through the load lifting zone in response to extension of the rod and housing elements relative to each other.

11. Draw works as defined in claim 10 wherein the rod element of the actuator is anchored to the base platform, the housing element being extendable along the rod element and carrying the traveling sheave means.

12. Draw works as defined in claim 10, the power transmission system including a third cable system coupled intermediate the load engaging means and the base platform, the third cable system being disposed in cooperative reeved engagement with the traveling sheave means and fixed sheave means for displacing the load engaging means through the load lifting zone in the direction opposite to the first direction in response to retraction of the rod and housing elements relative to each other.

13. Draw works for a hoist rig of the type including a horizontally extending base platform and a mast standing on the base platform comprising, in combination:

a crown block supported on the mast at a predetermined elevation above the base platform;

a traveling block disposed for reciprocal movement along the mast through a vertical load lifting zone intermediate the base platform and the crown block;

first and second crown sheaves rotatably mounted on the crown block;

first and second base sheaves rotatably mounted on the base platform;

a linear hydraulic actuator carried on said base platform having rod and housing elements, one of the elements being anchored to the base platform and the other element being supported for reciprocal movement along a stroke pathway extending transversely with respect to the load lifting zone;

first and second traveling sheaves rotatably mounted on the movable actuator element; and, first and second cables each having a first end portion attached to the traveling block, a second end portion anchored to the base platform, and an intermediate portion being successively reeved around the first and second crown sheaves, respectively, thence around the first and second base sheaves, respectively, and finally around the first and second traveling sheaves, respectively.

14. Draw works for lifting pipe from a well or for snubbing pipe into a well against the pressure of the well comprising:

a base platform;

an upright mast anchored to the base platform;

pipe engaging means movable along the mast having slip means for engaging the pipe and transmitting a snubbing force against the pipe in response to downward movement of the pipe engaging means and for transmitting a lifting force against the pipe in response to upward movement of the pipe engaging means;

a linear hydraulic actuator carried on said base platform having rod and housing elements, one of the elements being anchored to the base platform and the other element being supported for extension and retraction along a stroke pathway extending transversely with respect to the mast;

a traveling hoist sheave assembly journalled on the movable actuator element;

a traveling snub sheave assembly journalled on the movable actuator element;

a platform snub sheave assembly journalled on the base platform in the stroke pathway forward of the position reached by the traveling snub sheave assembly at the limit of its travel in extension;

a hoist power transmission system for driving the pipe engaging means upwardly along the mast including a crown hoist sheave assembly journalled near the top of the mast, a base hoist sheave assembly journalled near the bottom of the mast, and hoist cable means having a first end portion connected to the top of the pipe engaging means, a second end portion anchored to the base platform in the stroke pathway aft of the position reached by the traveling hoist sheave assembly at the limit of its travel in retraction, and an intermediate length extending upwardly along the mast, passing around the crown sheave means, extending downwardly along the mast and passing around the base hoist sheave assembly, extending forward along the base platform in parallel with the stroke pathway, passing around the traveling hoist sheave assembly and extending aft along the base platform to the anchor point; and, a snub power transmission system for driving the pipe engaging means downwardly along the mast including a crown snub sheave assembly journalled near the top of the mast, first and second base snub sheave assemblies journalled near the bottom of the mast, and snub cable means having a first end portion connected to the bottom of the pipe engaging means, a second end portion anchored to the base platform forward of the position reached by the traveling snub sheave assembly at the limit of its travel in extension, and an intermediate length extending from the pipe engaging means extending downwardly from the pipe engaging means along the mast, passing around the first base snub sheave assembly, extending upwardly along the mast in parallel with the hoist cable means, passing around the crown snub sheave assembly, extending downwardly along the mast in parallel with the hoist cable means, passing around the second base snub sheave assembly, extending forward along the base platform and passing around the platform snub sheave assembly, extending aft along the base platform and passing around the traveling snub sheave assembly, and extending forward along the base platform to the snub anchor point.

15. Draw works comprising:

a base platform;

an upstanding mast anchored to the base platform having structurally interconnected mast sections defining a vertical load transport zone along one side of the mast;

a traveling block including releasable slip means for gripping and exerting an upwardly or a downwardly directed force on a tubular member extending through the slip means;

a linear hydraulic actuator having rod and cylinder elements, one of the elements being anchored to the base platform and the other element being disposed for reciprocal movement along a stroke pathway extending generally parallel with the base platform;

a power transmission system for transporting the traveling block through the load transport zone including first and second traveling sheave assemblies journalled on the movable actuator element, first and second cable systems attached to vertically opposite sides of the traveling block and anchored to the base platform forward and aft of the positions reached by the traveling sheave assemblies during extension and retraction, respectively, first and second guide sheave assemblies journalled on the mast and on the base platform for guiding intermediate lengths of the first and second cable systems along parallel paths through the load transport zone and in parallel relation along the stroke path, an intermediate portion of the first cable system being disposed in reeved engagement with the first traveling sheave assembly and extending aft along the stroke path to the aft anchor point, and an intermediate portion of the second cable system being disposed in reeved engagement with the second traveling sheave assembly and extending forwardly along the stroke path to the forward anchor point, whereby the traveling block is driven upwardly and downwardly through the load transport zone in response to extension and retraction of the rod and housing elements, respectively.

16. Draw works for hoisting or snubbing a load comprising:

a base platform;

a mast standing erect on the base platform;

load engaging means disposed for reciprocal movement through a vertical load transport zone intermediate the base platform and the top of the mast;

a power transmission system for raising and lowering a load transported by the load engaging means including first and second cable systems coupled intermediate the load engaging means and the base platform, fixed sheave means journalled on the mast separately engaging the cable systems and guiding the load engaging means through the load transport zone, traveling sheave means separately engaging the first and second cable systems, respectively, and disposed for movement along the base platform through a stroke pathway which extends transversely with respect to the load transport zone, and fixed sheave means journalled on the base platform separately engaging the first and second cable systems and guiding the cable systems along separate runs aft and forward of the traveling sheave means, respectively, whereby the load engaging means is driven upwardly and downwardly in response to reciprocal movement of the traveling sheave means through the stroke pathway; and a linear hydraulic actuator carried on the base platform having rod and housing elements, one of the elements being anchored to the platform and the other carrying the traveling sheave means through the transverse stroke pathway, whereby the load engaging means is driven upwardly or downwardly through the load transport zone in response to extension and retraction of the rod and housing elements relative to each other, respectively.

17. Draw works for hoisting or snubbing a pipe string load comprising:

a base platform;

a mast standing erect on the base platform;

load engaging means disposed for reciprocal movement through a vertical load transport zone intermediate the base platform and the top of the mast;

a linear hydraulic actuator having rod and cylinder elements, one of the elements being anchored to the base platform and the other element being movable along a stroke pathway extending transversely with respect to the load transport zone; and, a power transmission system for driving the load engaging means through the load transport zone, the power transmission system including sheave means separately journalled on the mast, base platform and movable actuator element, respectively, hoist and snub cables coupled intermediate the load engaging means and the base platform, with intermediate portions of the hoist and snub cables being disposed in reeved engagement with the sheave means, whereby the hoist and snub cables coact with the sheave means for driving the load engaging means through the load transport zone in response to extension and retraction of the actuator elements.

18. Draw works as defined in claim 17, the mast comprising first and second elongated mast sections each having base and crown portions, and a crown block interconnecting the crown portions, the first and second mast sections being laterally spaced with respect to each other thereby defining lateral boundaries for the vertical load transport zone, the load engaging means comprising a traveling block extending laterally through the load transport zone and suspended by the cable systems in a horizontal position relative to the base platform throughout its range of movement in the load transport zone.

19. Draw works as defined in claim 17, the first and second cable systems each having terminal portions connected to vertically opposite sides of the load engaging means, respectively, each cable system comprising at least two cables with the terminal portions of each cable pair being connected on laterally opposite sides of the load engaging means.

20. Draw works as defined in claim 17, the power transmission system comprising:

a traveling hoist sheave assembly journalled on the movable actuator element;

a traveling snub sheave assembly journalled on the movable actuator element;

a platform snub sheave assembly journalled on the base platform in the stroke pathway forward of the position reached by the traveling snub sheave assembly at the limit of its travel in extension;

a hoist subsystem for driving the pipe engaging means upwardly along the mast including a crown hoist sheave assembly journalled near the top of the mast, a base hoist sheave assembly journalled near the bottom of the mast, and hoist cable means having a first end portion connected to the top of the pipe engaging means, a second end portion anchored to the base platform in the stroke pathway aft of the position reached by the traveling hoist sheave assembly at the limit of its travel in retraction, and an intermediate length extending upwardly along the mast, passing around the crown sheave assembly, extending downwardly along the mast and passing around the base hoist sheave assembly, extending forward along the base plaftorm in parallel with the stroke pathway, passing around the traveling hoist sheave assembly and extending aft along the base platform to the anchor point; and, a snub subsystem for driving the pipe engaging means downwardly along the mast including a crown snub sheave assembly journalled near the top of the mast, first and second base snub sheave assemblies journalled near the bottom of the mast, and snub cable means having a first end portion connected to the bottom of the pipe engaging means, a second end portion anchored to the base platform forward of the position reached by the traveling snub sheave assembly at the limit of its travel in extension, and an intermediate length extending from the pipe engaging means downwardly along the mast, passing around the first base snub sheave assembly, extending upwardly along the mast in parallel with the hoist cable means, passing around the crown snub sheave assembly, extending downwardly along the mast in parallel with the hoist cable means, passing around the second base snub sheave assembly, extending forward along the base platform and passing around the platform snub sheave assembly, extending aft along the base platform and passing around the traveling snub sheave assembly, and extending forward along the base platform to the snub anchor point.

21. Draw works as defined in claim 17, the power transmission system including:

a crown block supported on the mast at a predetermined elevation above the base platform;

a hoist sheave assembly and snub sheave assembly journalled on the crown block;

a hoist sheave assembly and snub sheave assembly journalled on the base platform;

a snub sheave assembly journalled on the mast near the base platform;

the hoist cables being laterally spaced and each having an intermediate length extending from the load engaging means upwardly along the aft side of the mast, passing around the crown hoist sheave assembly, extending downwardly along the forward side of the mast and passing around the base hoist sheave assembly;

the snub cables being laterally spaced and each having an intermediate length extending from the vertically opposite side of the load engaging means downwardly along the aft side of the mast, passing around the lower mast snub sheave assembly, extending upwardly along the forward side of the mast, passing around the crown snub sheave assembly, extending downwardly along the forward side of the mast, and passing around the base snub sheave assembly; and, a traveling crossbar interconnecting the downwardly extending hoist cables at a common length from the load engaging means, and also interconnecting the upwardly extending snub cables at a common length from the load engaging means, whereby the hoist and snub cables are anchored together for concurrent movement relative to each other.

22. Draw works as defined in claim 21, the sheaves of the crown hoist sheave assembly and the sheaves of the crown snub sheave assembly being journalled about axes which are mutually perpendicular, the axes of the crown hoist sheaves being in axial alignment, the axes of the crown snub sheaves extending in parallel with each other, and the crown snub sheaves being centered with respect to the crown hoist sheaves whereby the hoist and snub cables on the forward side of the mast being substantially co-planar with each other, and the traveling crossbar having vertically extending openings through which the downwardly extending snub cables pass.

23. Draw works as defined in claim 17, the sheave means journalled on the base platform and on the movable actuator element within the stroke pathway each including a trunnion and multiple sheaves journalled on the trunnion, the intermediate portions of the hoist and snub cables interconnecting the multiple sheaves in a multiple purchase arrangement whereby displacement of the movable actuator element will drive the load engaging means a greater proportional distance through the load transport zone.

24. Draw works as defined in claim 17, the sheave means journalled on the movable actuator element comprising a trunnion mounted near the end of the movable actuator element having bearing members projecting radially with respect to the axis of the movable actuator element, first and second traveling hoist sheave assemblies journalled on an opposite pair of the bearing members, and first and second traveling snub sheave assemblies journalled on the remaining pair of bearing members, intermediate portions of the hoist cables being reeved in a multiple purchase arrangement with the first and second traveling hoist sheave assemblies, and intermediate portions of the snub cables being reeved in a corresponding multiple purchase arrangement with the first and second traveling hoist sheave assemblies.

25. Draw works as defined in claim 17, the load engaging means comprising a traveling block having a rotary table and pipe slip and snubber bowls carried on the rotary table for engaging the pipestring.

26. In a workover rig for use with an oil well having an outer casing adapted to receive an inner pipe string and a well head including a flange connector coupled to the outer casing, the workover rig having a mast structure for vertical disposition above the well head, pipe engaging means disposed for reciprocal movement through a load transport zone along the mast, means for driving the pipe engaging means through the load transport zone while transferring the load imposed on the pipe engaging means to the mast, and structure for supporting the mast in an erect position overlying the well head, the combination with the mast support structure of a vertically adjustable stack assembly interposed between the mast and the well head flange connector for transmitting mast loads to the casing, the vertically adjustable stack assembly comprising:

a stack flange connector for engaging the well head flange connector;

first coupling means interconnecting the stack flange connector and the mast support structure, the length of the first coupling means being adjustable to drive the stack flange connector into compressive engagement with the well head flange connector; and, second coupling means interconnecting the stack flange connector and the mast, the length of the second coupling means being vertically adjustable to transfer the weight of the mast from the mast support structure to the well casing.

27. The combination as defined in claim 26, the first stack coupling means comprising:

a horizontal cross beam carrying the stack flange connector;

first and second upright support columns connected to the cross beam on laterally opposite sides of the stack flange connector;

first and second strut means projecting from the mast support structure each carrying a coupling member disposed in telescoping engagement with the first and second support columns, respectively; and, the second stack coupling means comprising:

third and fourth upright support columns connected intermediate the cross beam and the mast on laterally opposite sides of the stack flange connector, the intermediate length of the third and fourth upright support columns being vertically adjustable after the stack flange connector has been secured to the well head flange connector to transfer the weight of the mast from the mast support structure to the well casing.

28. The combination as defined in claim 27, the lower end portions of the first and second upright support columns being disposed in threaded engagement with the strut coupling members.

29. The combination as defined in claim 27, the first and second support columns each having a plurality of holes extending through their walls in equally spaced relation along the length of the columns, the horizontal cross beam having fastener collars on laterally opposite sides of the stack flange connector disposed in sliding concentric engagement with the support columns, the fastener collars each having a hole extending through their walls, and first and second stay pins disposed in registration engagement with the aligned holes of the support columns and the fastener collars.

30. The combination as defined in claim 26, the stack flange connector comprising an annular flange for mating engagement with the well head flange connector, and an annular stripper coaxially disposed with the annular flange for resiliently engaging the inner pipe string and sealing the annulus between the casing and the pipestring.

31. The combination as defined in claim 26, including slip means carried on the mast in vertical alignment with the stack flange connector for engaging and supporting the pipestring.

32. The combination as defined in claim 26, including a bolster assembly attached to the second coupling means for providing lateral support for a length of inner pipe string extending between the mast and the well head flange.

33. The combination as defined in claim 32, the bolster assembly comprising a plurality of bolster plates each having a central opening for receiving the length of pipe string, means linking the bolster plates for vertical movement relative to each other in parallel, stacked relation with their control openings concentrically aligned, and fastener means securing the bolster plates to the second coupling means in vertically spaced relation to each other.

34. In a workover rig for use with an oil well having an outer casing adapted to receive an inner pipe string and a well head including a flange connector coupled to the outer casing, the workover rig having a mast structure for vertical disposition above the well head, pipe engaging means disposed for reciprocal movement through a load transport zone along the mast, means for driving the pipe engaging means through the load transport zone while transferring the load imposed on the pipe engaging means to the mast, the combination with the mast of a stack assembly interposed between the mast and the well head flange connector for transmitting loads imposed on the mast by the pipe engaging means to the casing, the stack assembly comprising:

a stack flange connector for engaging the well head flange connector;

load coupling means interconnecting the stack flange connector and the mast; and, a bolster assembly attached to the load coupling means for providing lateral support for a length of inner pipe string extending between the mast and the well head flange.

35. The combination as defined in claim 34, the bolster assembly comprising a plurality of bolster plates each having a central opening for receiving the length of pipe string, means linking the bolster plates for vertical movement relative to each other in parallel, stacked relation with their central openings concentrically aligned, and fastener means securing the bolster plates to the load coupling means in vertically spaced relation to each other.

36. The combination as defined in claim 34, the load coupling means including a horizontal cross beam carrying the stack flange connector and upright support columns connected intermediate the cross beams and the mast on laterally opposite sides of the stack flange connector; and, the bolster assembly including a plurality of bolster plates each having central openings for receiving the length of pipe string and clevis fasteners formed along opposite sides of each plate engaging the upright support columns, link elements interconnected in a scissors arrangement on opposite sides of the bolster plates for permitting accordion-like movement of the bolster plates relative to each other in parallel, stacked relation with their central openings concentrically aligned, and clevis bolts securing the clevis fasteners to the upright support columns at a plurality of vertically spaced locations intermediate the mast and the stack flange connector.

37. A well drilling rig comprising, in combination:

a rigid mast structure for disposition vertically above a bore hole site;

pipe engaging means movable along the mast having an opening through which a tubular drill string including collars may pass and slip means for engaging the drill string to support the drill string and transmit vertical forces;

means for moving the pipe engaging means along the mast to raise and lower the pipe engaging means including a rotatable drill sub for stabbing engagement with the tubular drill string;

a drill power assembly movable along the mast in alignment with the bore hole axis above the pipe engaging means;

vertically yieldable support means interconnecting the drill power assembly and the pipe engaging means for permitting vertical displacement of the drill power assembly relative to the pipe engaging means while preventing rotation of the drill power assembly due to reacting torque forces on the drill power assembly which arise in response to rotary forces applied to the drill string.

38. The well drilling rig as defined in claim 37, the vertically yieldable support means comprising first and second upstanding stab receptacles anchored to the topside of the pipe engaging means on laterally opposite sides of the slip means, and first and second stab elements downwardly depending from the underside of the power drill assembly in stabbing alignment with the stab receptacles, each stab element being supported for vertical reciprocal movement between retracted and extended positions, and resilient means separately biasing each stab element to the fully extended position.

39. The well drilling rig as defined in claim 37, each stab element including a tubular housing anchored to the power drill assembly, a stanchion anchored to the power drill assembly and projecting through the tubular housing, a tubular piston telescopically received in overlapping engagement with the tubular housing, a spring coiled around the stanchion and anchored on one end to the tubular housing and anchored on its opposite end to the tubular piston, a stab rod projecting from the piston for stabbing engagement with the stab receptacle, the stab rod having a cavity for receiving the lower end of the stanchion when the piston is fully retracted, and a radially projecting collar secured to the piston near the union of the piston and stab rod for engaging the top of the stab receptacle.

40. The drilling rig as defined in claim 37, including crown sheave means journalled on the upper end of the mast, the means for moving the pipe engaging means including hoist cable means having an end portion attached to the pipe engaging means and an intermediate portion disposed in reeved engagement with the crown sheave means, and guide hooks carried by the yieldable support means engaging the hoist cable means.

41. The well drilling rig as defined in claim 37, including base sheave means journalled to the lower end of the mast structure, the means for moving the pipe engaging means including snub cable means having an end portion connected to the pipe engaging means and an intermediate portion disposed in reeved engagement with the base sheave means for exerting a downward force on the pipe engaging means.

42. The well drilling rig as defined in claim 37, the load engaging means comprising a traveling block having a rotary table and selectively actuable pipe gripping means carried on the rotary table for engaging the drill string.

43. The well drilling rig as defined in claim 48, the pipe gripping means comprising pipe slip and snubber bowls.

44. The well drilling rig as defined in claim 42, wherein the traveling block is provided with roller means which cooperatively engage and guide the traveling block along the mast.

45. A workover rig for launching and recovering pipe strings in a well comprising, in combination:

a rig support platform;

a mast support substructure mounted on the rig support platform for movement from a reclining transport position overlying the rig support platform to an elevated workover position overlying the well;

an elongated mast pivotally mounted on the mast support substructure for movement from a reclining transport position overlying the rig support platform to an erect workover position overlying and engaging the mast support substructure;

first power means operatively coupled intermediate the rig support platform and the mast support substructure for selectively moving the mast support substructure between the transport position and the elevated workover position;

second power means operatively coupled intermediate the mast support substructure and the mast for selectively moving the mast from the reclining transport position and the erect workover position;

load engaging means disposed for reciprocal movement through a vertical load transport zone intermediate the mast support substructure and the top of the mast;

a linear hydraulic actuator having rod and cylinder elements, one of the elements being anchored to rig base platform and the other element being movable along a stroke pathway extending transversely with respect to the load transport zone; and, a power transmission system for driving the load engaging means through the load transport zone, the power transmission system including sheave means separately journalled on the mast, rig platform and movable actuator element, respectively, hoist and snub cables coupled intermediate the load engaging means and the rig platform, with intermediate portions of the hoist and snub cables being disposed in reeved engagement with the sheave means, whereby the hoist and snub cables coact with the sheave means for driving the load engaging means through the load transport zone in response to extension and retraction of the actuator elements.

46. The workover rig as defined in claim 45 wherein the rig support platform comprises a portable trailer.

47. The workover rig as defined in claim 46, the mast support substructure comprising first and second pairs of lift arms coupled in parallel relation to each other intermediate the mast support substructure and the rig support platform, each lift arm being pivotally connected at opposite ends to the mast support substructure and the rig support platform, respectively, the combination of each pair of lift arms with the mast support substructure and the rig support platform defining a parallelogram throughout the range of movement of the mast support assembly from the transport position to the workover position.

48. The workover rig as defined in claim 45, the first and second power means each comprising a hydraulic cylinder assembly having piston and rod elements, the cylinder and rod element of the first power means each being pivotally connected to the rig support platform and the mast support substructure, respectively, and the cylinder and rod element of the second power means each being pivotally connected to the mast support structure and the mast, respectively.

49. The workover rig as defined in claim 45, the mast support substructure including a cantilever mast support base projecting beyond the portable rig support platform in the workover position.

50. The workover rig as defined in claim 45, the mast support substructure comprising a cantilever mast support base and first and second pairs of lift arms coupled in parallel relation to each other on laterally opposite sides of the cantilever support base with each lift arm being pivotally connected at opposite ends to the rig support platform and the cantilever support base, respectively, the combination of each pair of lift arms with the cantilever support base and rig support platform defining a parallelogram for maintaining the cantilever support base in parallel alignment with the base platform member throughout the range of movement from the transport position to the elevated position of use.

51. A workover rig as defined in claim 45 wherein the rod element of the linear hydraulic actuator is anchored to the rig support platform, the housing element being extendable along the rod element and carrying traveling sheave means through a horizontal stroke pathway, and including a guide tube anchored to the rig support tube receiving the horizontally projecting end of the extendable actuator housing element in telescoping, overlapping relation for stabilizing the actuator housing element.

52. A workover rig for launching and recovering pipe strings in an offshore well comprising, in combination:

a barge transportable skid for offshore duty;

a mast pivotally coupled to the skid for erection from a reclining transport position to an upright workover position, the mast having structurally interconnected mast sections defining a load transport zone along the mast;

a traveling block including releasable slip means for gripping and exerting an upwardly or a downwardly directed force on a tubular member extending through the slip means;

a linear hydraulic actuator having rod and cylinder elements, one of the elements being anchored to the skid and the other element being disposed for reciprocal movement along a stroke pathway extending generally parallel with the skid; and, a power transmission system for driving the traveling block through the load transport zone, the power transmission system including sheave means separately journalled on the mast, rig platform and movable actuator element, respectively, hoist and snub cables coupled intermediate the load engaging means and the rig platform, with intermediate portions of the hoist and snub cables being disposed in reeved engagement with the sheave means, whereby the hoist and snub cables coact with the sheave means for driving the load engaging means through the load transport zone in response to extension and retraction of the actuator elements.

53. The workover rig as defined in claim 52, the barge transportable skid comprising:

an elongated below deck supporting the linear hydraulic actuator and sheave means;

an elongated super deck supported on the below deck at an elevation above the hydraulic actuator and sheaves;

safety rails extending along both sides of the super deck; and, a pipe rack secured to the super deck intermediate the safety rails, thereby defining walkways intermediate the safety rails and the pipe rack.

54. In a workover rig adapted for use with a well having an outer well pipe enclosing casing terminating at a flanged well head, support structure for a transportable mast comprising:

a trailer having a load bearing frame including a rear deck for supporting hoist operations and a forward deck having a coupling member for towing engagement with a tractor;

first and second pairs of ground engaging jacks secured to the forward and rear decks, respectively, for stabilizing the load bearing frame of the trailer during workover operations;

an intermediate mast support base including a carriage assembly and a cantilever portion projection from the carriage assembly;

first and second struts having ground engaging stabilizer pads coupled in hinged engagement with the cantilever portion of the intermediate support base, first and second chains connected intermediate the load bearing trailer frame and the struts, respectively, a third chain connected intermediate the first and second struts, and means coupled to each chain for adjusting its effective length;

means coupled intermediate the rear deck and the carriage assembly for moving the intermediate support base from a transport position overlying the rear deck to an elevated operating position wherein the cantilever portion is extended beyond the tailboard of the rear deck;

means connecting the base portion of the mast in hinged engagement with the cantilever portion for permitting pivotal movement of the mast from a reclining transport position overlying the rear and forward decks to an erect hoist position extending above and resting in load bearing engagement upon the cantilever portion;

means coupled intermediate the carriage assembly and the base section of the mast for driving the mast in pivotal movement about the hinge means from the reclining transport position to the erect hoist position;

a stack flange connector for engaging the well head flange connector;

first coupling means anchoring the stack flange connector to the trailer frame, the length of the first coupling means being adjustable to drive the stack flange connector into compressive engagement with the well head flange connector; and, second coupling means anchoring the stack flange connector to the intermediate mast support base, the length of the second coupling means being vertically adjustable to transfer the weight of the mast from the mast support structure to the well casing.

55. The combination as defined in claim 54, the carriage assembly comprising first and second pairs of lift arms coupled in parallel relation to each other on laterally opposite sides of the cantilever support base with each lift arm being pivotally connected at opposite ends to the trailer deck and the cantilever support base, respectively, the combination of each pair of lift arms with the cantilever support base and rig support platform defining a parallelogram for maintaining the cantilever base in parallel alignment with the rig support platform throughout its range of movement from the transport position on the elevated workover position.

56. A workover rig for launching and recovering pipe strings in a well comprising, in combination:

a rig support platform;

a mast support structure mounted on the rig support platform for movement from a reclining transport position overlying the rig support platform to an elevated workover position overlying the well;

an elongated mast pivotally mounted on the mast carriage assembly for movement from a reclining transport position overlying the rig support platform to an erect workover position overlying and engaging the mast support substructure;

first power means operatively coupled intermediate the rig support platform and the mast support assembly for selectively moving the mast support substructure between the transport position and the elevated workover position;

second power means operatively coupled intermediate the mast support assembly and the mast for selectively moving the mast from the reclining transport position and the erect workover position;

load engaging means disposed for reciprocal movement through a vertical load transport zone intermediate the mast support substructure and the top of the mast;

a linear hydraulic actuator having rod and cylinder elements, one of the elements being anchored to rig base platform and the other element being movable along a stroke pathway extending transversely with respect to the load transport zone; and a power transmission system for driving the load engaging means through the load transport zone, the power transmission system including:

a traveling hoist sheave assembly journalled on the movable actuator element;

a traveling snub sheave assembly journalled on the movable actuator element;

a platform snub sheave assembly journalled on the rig support platform in the stroke pathway forward of the position reached by the traveling snub sheave assembly at the limit of its travel in extension;

a hoist power transmission system for driving the pipe engaging means upwardly along the mast including a crown hoist sheave assembly journalled near the top of the mast, a base hoist sheave assembly journalled near the bottom of the mast, and hoist cable means having a first end portion connected to the top of the pipe engaging means, a second end portion anchored to the base platform in the stroke pathway aft of the position reached by the traveling hoist sheave assembly at the limit of its travel in retraction, and an intermediate length extending upwardly along the mast, passing around the crown sheave means, extending downwardly along the mast and passing around the base hoist sheave assembly, extending forward along the rig support platform in parallel with the stroke pathway, passing around the traveling hoist sheave assembly and extending aft along the rig support platform to the anchor point; and, a snub power transmission system for driving the pipe engaging means downwardly along the mast including a crown snub sheave assembly journalled near the top of the mast, first and second base snub sheave assemblies journalled near the bottom of the mast, and snub cable means having a first end portion connected to the bottom of the pipe engaging means, a second end portion anchored to the rig support platform forward of the position reached by the traveling snub sheave assembly at the limit of its travel in extension, and an intermediate length extending from the pipe engaging means extending downwardly from the pipe engaging means along the mast, passing around the first base snub sheave assembly, extending upwardly along the mast in parallel with the hoist cable means, passing around the crown snub sheave assembly, extending downwardly along the mast in parallel with the hoist cable means, passing around the second base snub sheave assembly, extending forward along the base platform and passing around the platform snub sheave assembly, extending aft along the rig support platform and passing around the traveling snub sheave assembly, and extending forward along the rig support platform to the snub anchor point.

57. A workover rig for launching and recovering pipe strings in an offshore well comprising, in combination:

a barge transportable skid for offshore duty;

a mast pivotally coupled to the skid for erection from a reclining transport position to an upright workover position, the mast having structurally interconnected mast sections defining a load transport zone along the mast;

a traveling block including releasable slip means for gripping and exerting an upwardly or a downwardly directed force on a tubular member extending through the slip means;

a linear hydraulic actuator having rod and cylinder elements, one of the elements being anchored to the skid and the other element being disposed for reciprocal movement along a stroke pathway extending generally parallel with the skid; and, a power transmission system for driving the traveling block through the load transport zone, the power transmission system including:

a traveling hoist sheave assembly journalled on the movable actuator element;

a traveling snub sheave assembly journalled on the movable actuator element;

a platform snub sheave assembly journalled on the base platform in the stroke pathway forward of the position reached by the traveling snub sheave assembly at the limit of its travel in extension;

a hoist subsystem for driving the pipe engaging means upwardly along the mast including a crown hoist sheave assembly journalled near the top of the mast, a base hoist sheave assembly journalled near the bottom of the mast, and hoist cable means having a first end portion connected to the top of the pipe engaging means, a second end portion anchored to the base platform in the stroke pathway aft of the position reached by the traveling hoist sheave assembly at the limit of its travel in retraction, and an intermediate length extending upwardly along the mast, passing around the crown sheave assembly, extending downwardly along the mast and passing around the base hoist sheave assembly, extending downwardly along the mast and passing around the base hoist sheave assembly, extending forward along the base platform in parallel with the stroke pathway, passing around the traveling hoist sheave assembly and extending aft along the base platform to the anchor point; and, a snub subsystem for driving the pipe engaging means downwardly along the mast including a crown snub sheave assembly journalled near the top of the mast, first and second base snub sheave assemblies journalled near the bottom of the mast, and snub cable means having a first end portion connected to the bottom of the pipe engaging means, a second end portion anchored to the base platform forward of the position reached by the traveling snub sheave assembly at the limit of its travel in extension, and an intermediate length extending from the pipe engaging means downwardly along the mast, passing around the first base snub sheave assembly, extending upwardly along the mast in parallel with the hoist cable means, passing around the crown snub sheave assembly, extending downwardly along the mast in parallel with the hoist cable means, passing around the second base snub sheave assembly, extending forward along the base platform and passing around the platform snub sheave assembly, extending aft along the base platform and passing around the traveling snub sheave assembly, and extending forward along the base platform to the snub anchor point.

* * * * *

UNITED STATES PATENT AND TRADEMARK OFFICE

CERTIFICATE OF CORRECTION

PATENT NO. : 4,290,495

DATED : September 22, 1981

INVENTOR(S) : Mr. Thomas L. Elliston

It is certified that error appears in the above—identified patent and that said Letters Patent is hereby corrected as shown below:

Column 13, line 45, "corwn" should be --crown--.

Column 29, line 64, "48" should be --42--.

Signed and Sealed this

*Ninth* Day of *February 1982*

[SEAL]

*Attest:*

GERALD J. MOSSINGHOFF

*Attesting Officer* *Commissioner of Patents and Trademarks*